US009272873B2

(12) United States Patent
DiGenova

(10) Patent No.: US 9,272,873 B2
(45) Date of Patent: Mar. 1, 2016

(54) PRINTING PRESS, FOLDER, AND METHODS OF OPERATION

(71) Applicant: Pressline Services, Inc., St. Louis, MO (US)

(72) Inventor: Phillip DiGenova, Tierra Verde, FL (US)

(73) Assignee: Pressline Services, Inc., St. Louis, MO (US)

( * ) Notice: Subject to any disclaimer, the term of this patent is extended or adjusted under 35 U.S.C. 154(b) by 0 days.

(21) Appl. No.: 14/557,209

(22) Filed: Dec. 1, 2014

(65) Prior Publication Data

US 2015/0151534 A1 Jun. 4, 2015

Related U.S. Application Data

(63) Continuation of application No. 12/407,689, filed on Mar. 19, 2009, now Pat. No. 8,925,459.

(60) Provisional application No. 61/040,031, filed on Mar. 27, 2008, provisional application No. 61/040,034, filed on Mar. 27, 2008, provisional application No. 61/040,037, filed on Mar. 27, 2008.

(51) Int. Cl.

| | |
|---|---|
| ***B41F 33/00*** | (2006.01) |
| ***B65H 45/12*** | (2006.01) |
| ***B41F 13/02*** | (2006.01) |
| ***B41F 13/10*** | (2006.01) |
| ***B41F 13/56*** | (2006.01) |
| ***B41F 13/60*** | (2006.01) |
| ***B65H 45/16*** | (2006.01) |

(Continued)

(52) U.S. Cl.

CPC ..... *B65H 45/12* (2013.01); *B41F 13/02* (2013.01); *B41F 13/08* (2013.01); *B41F 13/10* (2013.01); *B41F 13/56* (2013.01); *B41F 13/60* (2013.01); *B41F 27/12* (2013.01); *B41F 33/0009* (2013.01); *B65H 45/162* (2013.01); *B41P 2227/11* (2013.01); *B41P 2227/12* (2013.01)

(58) Field of Classification Search

CPC ..... B41F 13/54; B41F 7/02; B41F 7/04; B41F 13/024; B41F 13/44

See application file for complete search history.

(56) References Cited

U.S. PATENT DOCUMENTS 2,821,134 A * 1/1958 Brodie ..... 101/217
5,520,378 A 5/1996 Kepert et al.

(Continued)

FOREIGN PATENT DOCUMENTS

DE 10106985 A1 8/2002
DE 102006057469 A1 2/2008

(Continued)

OTHER PUBLICATIONS

"Pressman's Manual 254 Rockwell-Goss Metroliner Folder," Rockwell International, undated, 148 pages.

(Continued)

*Primary Examiner* — David Banh
(74) *Attorney, Agent, or Firm* — Lewis Rice LLC

(57) ABSTRACT

Systems and methods for allowing existing rotary printing press units to produce smaller pages at a faster rate of speed without having to replace the press unit. Specifically, the systems and methods relate to retrofitting an existing press unit to produce three pages of material in each full rotation instead of the traditional two pages.

7 Claims, 13 Drawing Sheets

(51) Int. Cl.
*B41F 13/08* (2006.01)
*B41F 27/12* (2006.01)

(56) References Cited

U.S. PATENT DOCUMENTS

| | | | | |
|---|---|---|---|---|
| 5,775,222 | A | 7/1998 | Zweifel et al. | |
| 5,868,071 | A * | 2/1999 | Niemiro et al. | 101/218 |
| 7,032,515 | B2 | 4/2006 | Zimich et al. | |
| 7,707,934 | B2 | 5/2010 | Herbert et al. | |
| 2002/0134264 | A1 * | 9/2002 | Okubo et al. | 101/401.1 |
| 2002/0189470 | A1 * | 12/2002 | Holm | 101/375 |
| 2004/0069168 | A1 * | 4/2004 | Brown et al. | 101/226 |
| 2004/0079247 | A1 * | 4/2004 | Dylla | 101/217 |
| 2004/0244615 | A1 | 12/2004 | Herbert et al. | |
| 2005/0068336 | A1 | 3/2005 | Van Dyke et al. | |
| 2005/0126413 | A1 * | 6/2005 | Tabor et al. | 101/479 |
| 2005/0199147 | A1 * | 9/2005 | Schafer et al. | 101/415.1 |
| 2006/0217141 | A1 | 9/2006 | Legg et al. | |
| 2007/0161486 | A1 * | 7/2007 | Richards | 493/419 |
| 2007/0221076 | A1 * | 9/2007 | Reardon | 101/227 |
| 2007/0261576 | A1 * | 11/2007 | Muller et al. | 101/216 |
| 2008/0028965 | A1 * | 2/2008 | Herbert et al. | 101/453 |
| 2009/0282998 | A1 * | 11/2009 | Richards | 101/227 |

FOREIGN PATENT DOCUMENTS

| | | | |
|---|---|---|---|
| JP | 56-047102 | A | 4/1981 |
| JP | 07-005694 | A | 1/1995 |
| JP | 08-090946 | A | 4/1996 |
| JP | 2007296850 | A | 11/2007 |
| WO | 2005068336 | A1 | 7/2005 |
| WO | 2005105445 | A1 | 11/2005 |
| WO | 2005108078 | A1 | 11/2005 |
| WO | 2007112017 | A2 | 10/2007 |
| WO | 2008017712 | A1 | 2/2008 |
| WO | 2009120582 | A2 | 10/2009 |

OTHER PUBLICATIONS

Frei, Oscar, "Web-Fed Offset Printing Techniques Systems Machines," 1979, p. 49 (cover sheet, imprint), Polygraph Verlag GmbH, Frankfurt am Main, Germany, 3 pages.

"280-MM Maintenance Manual Goss Metroliner II Printing Units With Injector Ink System," Rockwell International, Oct. 1981 (revised Feb. 1988), 78 pages.

Walenski, Wolfgang, "Web-fed Offset Printing," 1995, pp. 206-207 (cover sheet, imprint), Fachschriften-Verlag GmbH & Co. KG, 4 pages.

"Angular Velocity," Wikipedia, http://en.wikipedia.org/wiki/Angular_velocity, last modified on Mar. 23, 2008, 5 pages.

International Search Report, International Patent Application No. PCT/US2009/037715, mailed on Oct. 13, 2009, 11 pages.

Notice of Opposition, European patent 2259924 B1, filed by Manroland web systems GmbH, Augsburg, Germany on Oct. 1, 2014, http://www.kba.com/downloads-glossar/supportdownloads/kba-report/, 30 pages.

Excerpts from KBA Report, No. 13, Issue 2, 1999, http://www.kba.com/presse-aktuelles/unternehmen-ir/page/56/, 3 pages.

Screenshot of KBA Report 13, 1 page.

Excerpts from KBA Report, No. 14, Issue 1, 2000, 5 pages.

Screenshot of KBA Report 14, 1 page.

Contract/Agreement between Man Roland and PMP Print PTY Ltd., Clayton, Victoria, Australia, dated May 30, 2004, 4 pages.

Acceptance Certificate/Transfer Protocol between Man Roland and PMP Print PTY Ltd., dated Mar. 21, 2006, 1 page.

Technical Specifications, Lithoman IV 64, dated Apr. 29, 2004, 15 pages.

Feature analysis claim against EP 2259924 B1, brought by Manroland Web Systems GmbH, 1 page.

Extended Search Report, European Patent Application No. 13154371.2, mailed on Apr. 3, 2013, 5 pages.

Examination Report, Australian Patent Application No. 2009228564, Feb. 21, 2013, 6 pages.

Examination Report, Chilean Patent Application No. 1043-10, Sep. 20, 2010, 7 pages.

Examination Report, Colombian Patent Application No. 10-129908, Apr. 4, 2013, 13 pages.

Search Report, European Patent Application No. 09724763.9, May 27, 2011, 8 pages.

Search Report, European Patent Application No. 13154371.2, Apr. 3, 2013, 5 pages.

Examination Report, Japanese Patent Application No. 2011-501924, Feb. 19, 2013, 6 pages.

* cited by examiner

PRINTING PRESS, FOLDER, AND METHODS OF OPERATION

CROSS REFERENCE TO RELATED APPLICATION(S)

This application is a Continuation of U.S. patent application Ser. No. 12/407,689, filed, Mar. 19, 2009, which in turn claims the benefit of U.S. Provisional Patent Application Ser. No. 61/040,031, filed Mar. 27, 2008; U.S. Provisional Patent Application Ser. No. 61/040,034, filed Mar. 27, 2008; and U.S. Provisional Patent Application Ser. No. 61/040,037, filed Mar. 27, 2008. The entire disclosure of all these documents is herein incorporated by reference.

BACKGROUND

1. Field of the Invention

This disclosure relates to the field of rotary presses. In particular, to the conversion or retrofitting of existing rotary presses to allow for printing a different number of sheets per rotation than the press was originally designed to print, a folder to operate on such a printing, presslines utilizing such components, and methods of operating such presses, folders, and presslines to produce a differently sized end-product.

2. Description of the Related Art

The adage that time is money is certainly true in the newspaper or publication printing industry. The faster that printing presses can generate a final product, the fewer manhours and resources (e.g., electricity) are required to generate that product; such resource conservation may increase net revenue and make the publication more profitable. Increasing the speed of production also means that fewer press units are required to generate a publication within the generally fixed period of time between when a newspaper is ready for print, and the printing is completed and the newspaper is ready to deliver, decreasing the amount of capital investment and maintenance required.

However, the rate of operation of a printing press is limited by its structural capacity for speed. The large mechanical components of a printing press may not last as long, may be more prone to being damaged, and may be more dangerous to operate, if they are pushed to operate at a speed that is too high. Specifically in a rotary press, the speed of printing has previously been dictated by the rotational speed of the plate and blanket cylinders which are designed to operate at a defined maximum speed.

Another problem in the newspaper or publication printing industry is the bulky and unwieldy size of many larger publications. As the world has become more mobile, and readers utilize the publication in new places, large newspaper pages may be considered difficult to manipulate, particularly for readers in confined spaces such as public transportation, crowded coffeeshops, airplanes, aerobic machines at a fitness center, or the like. As opposed to magazines which are quite compact, newspapers often have large pages not well suited to such uses as the pages will flop around, be unsupported, and be difficult to hold in a viewable position. Even readers without space restrictions may prefer a more compact newspaper simply because it can be easier to handle. It is therefore desirable to rebalance or redesign newspaper sizes to generate a more user-friendly, and therefore more desirable, final product. One manner of doing so may be to shorten both dimensions of the newspaper to allow for a smaller size to be printed while still maintaining familiar size ratios.

While the size of a newspaper can make a newspaper less relevant in today's hectic society, the format and type of presentation can also present problems. Many newspaper presslines were built to print in black and white. Color was, therefore, relatively rare. However, because of changes in technology, consumers are expecting printed matter to be in full color more and more. Since a pressline is a large fixed capital investment, the difficulty of the prior presslines to move toward increased color can present a stumbling block to producing a desirable product without significant additional capital investment.

In addition to operating more quickly and generating a more user-friendly and relevant publication, it is also desirable to conserve paper. In the last few years, paper recycling to reuse discarded paper has become a much more common activity and has become, for many, a big business. Further, as increased political pressure is brought to bear on paper use and paper recycling, paper has generally increased in price to accommodate increased recycling as well as to encourage more efficient use of new and recycled paper.

For a newspaper, the cost of the raw newsprint upon which to print the newspaper can be the most important consideration in whether the newspaper can survive in the marketplace and can be the most significant cost in operating the newspaper. In today's world, a newspaper must compete against radio, television, and the Internet for its share of advertiser's dollars spent towards reporting. As these other technologies are not bound by the use of paper, the cost of raw newsprint can determine whether or not a newspaper can compete and ultimately survive. Newsprint pricing regularly fluctuates on a quarterly basis which can often leave the newspaper uneasy about how the bottom line will look at the end of the year as even a small fluctuation in the last quarter can cancel out the profit margin built into the paper at the beginning of the year.

Most newspaper presslines running today were installed in the 1970's and 1980's before newsprint prices were inflated to the point they are today, when newsprint prices were more stable, and before the need to conserve paper was fully understood. When these presses were installed, the printed size of a page of a newspaper and therefore the size and design of the newspaper presses was generally selected to obtain a particular look of the paper or to allow a particular number of articles of a particular size to appear on various pages, instead of to preserve newsprint. For these reasons, many of these presses utilize newspaper pages which are significantly larger than their more modern counterparts. In the newspaper business, this difference in the newspaper size can result in a massive difference in profitability in the market.

In a newspaper, there are effectively two dimensions of the paper which can be controlled and which determine the amount of paper which is required to print each newspaper. A single sheet of newspaper (the pages which connect in the middle and printed on each side (four pages)) is generally a quadrilateral shape. A newspaper printing press will generally print newspaper pages on a roll of paper (or a paper web as it is often called). This web is printed with multiple sheets across the width of the paper roll (two or more sheets or eight or more pages) with these same pages repeated down the roll of paper. Alternatively, the press may print a first row of sheets, and then a second row below that, before repeating the same pattern of rows. In this way, the newspaper sheets are essentially printed repetitively (serially) on the roll as it is unwound.

This design results because the press generally utilizes a continuously revolving cylinder as the printing surface to print the page. The cylinder has a length corresponding to the width of the paper roll and generally prints one or two pages with each revolution of the cylinder along the length of the roll of paper. Different sheets are printed on a different paper roll (generally on a different press unit) with the newspaper comprising the appropriate sheets from a plurality of press units being properly arranged, cut and folded together. In this way the newspaper is printed as one continuous printing operation without need to pause printing between pages.

As the pages are generally printed upright, to utilize a smaller horizontal dimension and change the paper's size and look, a narrower paper roll is used and the press is generally set up to not utilize the entire width of the printing surface but only that which corresponds to the width of the roll (the ends of the printing cylinder are contacting only empty space as there is no paper to contact). Alternatively, a wider paper roll could be used utilizing more of the length of the printing cylinder and the system could be set up to print more sheets along the width of the paper. For example three narrower sheets (12 pages) may be printed along the width of a slightly wider roll of paper instead of the wider sheets on a narrower paper roll.

Because of the way a rotary press is designed, while this horizontal dimension modification is fairly easy and straightforward and requires no real modification to the printing hardware (since you are effectively "printing air" with the unused capacity), it is difficult to change the height dimension of a newspaper or what is generally called the "cut-off" or "cut-off length." Because the printing cylinder has a fixed circumference and because the cylinder endlessly rotates providing the repeated pattern of pages, the circumference of the cylinder corresponds to a predetermined number of complete pages. While one can easily configure the cylinder to print blank space at the end of each rotation (e.g., only having ⅞ of the cylinder actually "print"), there is no net paper savings as this unprinted area is not empty, but comprises unused paper which then has to be cut from the resultant pages (taking an additional cutting step) and is waste. Thus, while smaller vertically sized pages can be printed, such printing does not avoid many of the problems of printing the larger pages since there is no paper savings and the step of removing unprinted paper generally complicates and slows the printing process.

In some dynamic presses, the printing cylinder could be modified dynamically so that a continuously changing pattern of repeating pages could be printed to allow for a printing cylinder to print a non-whole number of pages with each revolution, but such a dynamic system is prohibitively expensive in most situations and sufficiently difficult to operate that it is unusable for most newspaper printing operations.

Many newspaper presslines in use today that were installed prior to the interest in paper reduction and speed so they utilize a newspaper page height of 22¾" or 23⁹⁄₁₆". Today, new newspaper presslines are installing new presses that print lengths of 21", 18.5", or 17" length to save paper and to print faster. These presses can save 8% to 10% of the newsprint over what an older press uses which is a gigantic savings in cost and materials. They may also produce product more quickly. Further, more modern presses are often set up to provide for increased color use than their prior composition. Therefore, there is a need in the art to have systems and methods for allowing an older press unit utilizing a first cut-off length, to be modified so as to have a new shorter cut-off length without producing wasted paper between individual sheets.

Existing press units are large, heavy, and expensive pieces of machinery. The press units and folder principally comprise a large frame formed out of a material such as cast iron or steel with holes bored therethrough to enable the attachment of the various moveable components in a precise relation. It may not be feasible or desirable to make large-scale adjustments to existing press units or folders, given the cost and precision such adjustments may require. Further, the cost to replace press units and folders with more modern units is often prohibitive, especially for a smaller publication. It is therefore desirable to shorten the page length and increase the rate of production without need for such a large capital expenditure.

SUMMARY

Due to these and other problems in the art, disclosed herein, among other things, is a method of reducing the cut-off length of a newspaper, the method comprising: replacing a first plate cylinder of a press unit with a corresponding second plate cylinder having generally the same length, diameter, and circumferences as the first plate cylinder while making no further modifications to the press unit; printing pages on the press unit, the printing comprising running the press unit at the same speed it had run prior to the replacing; and utilizing a four cylinder folder to provide for cutting and folding the pages; wherein the first plate cylinder comprises a first number of plates equally distributed around the circumference of the first plate cylinder; and wherein the second plate cylinder comprises a second number of plates equally distributed around the circumference of the second plate cylinder.

In an embodiment of the method the second number of plates is greater than the first number of plates, the second number of plates may be two and the second number of plates may be three.

In an embodiment the second number of plates may be an odd number or an even number.

In an embodiment, the first number of plates is two and the second number of plates is one. The second plate cylinder may be set up to print three pages during each revolution of the plate cylinder.

In an embodiment, the method further comprises replacing a first blanket cylinder in the press unit with a second blanket cylinder cooperative with the second plate cylinder.

In an embodiment of the method replacing the first plate cylinder is removed from the press unit and replaced by the second plate cylinder. Alternatively, the replacing first plate cylinder is modified to become the second plate cylinder.

In an embodiment, the method further comprises repeating the replacing for each plate cylinder in the press unit.

In an embodiment of the method the folder is selected from the group consisting of: a 2:4:4 folder, a 3:3:5:5 folder, a 4:4:5:5 folder, a 2:4:5:5 folder, a 3:4:5:5 folder. The folder may operate in a collect run or a straight run.

There is also described herein a retrofitted pressline which produces printed matter having a reduced cut-off length, the pressline comprising: a retrofitted press unit having previously had a first plate cylinder with a first number of plates equally distributed around the circumference of the first plate cylinder replaced with a second plate cylinder of the same length and diameter as the first plate cylinder; the second plate cylinder comprising a second number of plates equally distributed around the circumference of the second plate cylinder; and a retrofitted folder wherein the folder has had three cylinders replaced with four cylinders; wherein the retrofitted pressline occupies the same footprint as the same pressline prior to retrofitting.

In an embodiment of the pressline the first number of plates is two and the second number of plates is three. Alternatively, the first number of plates is two and second number of plates is one.

In an embodiment of the pressline the folder is selected from the group consisting of: a 2:4:4:4 folder, a 3:3:5:5 folder, a 4:4:5:5 folder, a 2:4:5:5 folder, a 3:4:5:5 folder.

There is also described herein a pressline which produces printed matter having a reduced cut-off length, the pressline comprising: a retrofitted press unit having previously had a first plate cylinder with a first number of plates equally distributed around the circumference of the first plate cylinder replaced with a second plate cylinder of the same length and diameter as the first plate cylinder; the second plate cylinder comprising three plates equally distributed around the circumference of the second plate cylinder; and a four cylinder folder.

There is also described herein a method of retrofitting a pressline over time, the method comprising: having a pressline which is designed to operate in a two-around printing mode; selecting a press unit in the pressline; replacing the plate cylinders of the press unit with corresponding second plate cylinders having generally the same length, diameter, and circumferences as the first plate cylinders but having only a single plate, while making no further modifications to the press unit; repeating the steps of selecting and replacing on all press units in the pressline; printing pages on all other press units in the pressline while the repeating is ongoing utilizing a two-around mode; and printing pages on the pressline in three-around mode once all the press units have been selected.

In an embodiment, the method further comprises replacing the blanket cylinders in the press unit with second blanket cylinders cooperative with the second plate cylinders.

In an embodiment or the method wherein the replacing the plate cylinders comprises removing the first plate cylinders from the press unit and replaced them with the second plate cylinders alternatively, replacing the plate cylinders comprises removing the first plate cylinders from the press unit and modifying them to become the second plate cylinders.

In an embodiment, the method further comprises a folder for folding pages in the three-around mode which may be selected from the group consisting of: a 2:4:4:4 folder, a 3:3:5:5 folder, a 4:4:5:5 folder, a 2:4:5:5 folder, a 3:4:5:5 folder. This folder may operate in a collect run or a straight run.

In an embodiment of the method there is also included a folder for folding pages in the two-around mode which folder may operate in a collect run or a straight run.

There is also described herein a method of retrofitting a newspaper pressline over time, the method comprising: replacing the plate cylinders of each press unit with corresponding second plate cylinders having generally the same length, diameter, and circumferences as the first plate cylinders but having only a single plate, while making no further modifications to the press unit; replacing a folder of the pressline with a folder designed to fold a three-around mode printed newspaper while maintaining another folder of the pressline to fold a two-around mode printed newspaper; printing pages on the pressline utilizing a two-around mode until the steps of replacing are completed; and printing pages on the pressline in three-around mode once the steps of replacing are completed.

In an embodiment the method further comprises replacing the blanket cylinders in the press unit with second blanket cylinders cooperative with the second plate cylinders.

In an embodiment of the method, the replacing the plate cylinders comprises removing the first plate cylinders from the press unit and replaced them with the second plate cylinders. Alternatively, replacing the plate cylinders comprises removing the first plate cylinders from the press unit and modifying them to become the second plate cylinders.

In an embodiment of the method, the folder is selected from the group consisting of: a 2:4:4:4 folder, a 3:3:5:5 folder, a 4:4:5:5 folder, a 2:4:5:5 folder, a 3:4:5:5 folder. The folder may operate in a collect run or a straight run.

There is also described a method of retrofitting a newspaper pressline over time, the method comprising: replacing the plate cylinders of each press unit with corresponding second plate cylinders having generally the same length, diameter, and circumferences as the first plate cylinders but having three plates, while making no further modifications to the press unit; replacing a folder of the pressline with a folder designed to fold a three-around mode printed newspaper while maintaining another folder of the pressline to fold a two-around mode printed newspaper; printing pages on the pressline utilizing a two-around mode until the steps of replacing are completed; and printing pages on the pressline in three-around mode once the steps of replacing are completed.

In an embodiment the method further comprises replacing the blanket cylinders in the press unit with second blanket cylinders cooperative with the second plate cylinders.

In an embodiment of the method the replacing the plate cylinders comprises removing the first plate cylinders from the press unit and replaced them with the second plate cylinders. Alternatively, the replacing the plate cylinders comprises removing the first plate cylinders from the press unit and modifying them to become the second plate cylinders.

In an embodiment of the method, the folder is selected from the group consisting of: a 2:4:4:4 folder, a 3:3:5:5 folder, a 4:4:5:5 folder, a 2:4:5:5 folder, a 3:4:5:5 folder. The folder may operate in a collect run or a straight run.

There is also described herein a retrofitted printing apparatus comprising: an existing press unit having a first plate cylinder which has previously been removed; a replacement second plate cylinder for receiving ink, the second plate cylinder comprising at least three plates and having the same diameter and length as the first plate cylinder installed in the press unit; and a blanket cylinder for transferring the ink from the second plate cylinder to paper.

In an embodiment of the apparatus the replacement second plate cylinder further comprises: a first end; a second end; a first section corresponding to the first end, the first section comprising a first number of plates; and a second section corresponding to the second end, the second section comprising a second number of plates.

In an embodiment of the apparatus the replacement second plate cylinder comprises: a first end; a second end; a cylindrical shaft between the first end and the second end, the shaft having a circumference; and at least three plates covering the shaft, each of the plates occupying an equal portion of the circumference. This equal portion may comprise an arc of 120°.

In an embodiment of the apparatus the first plate cylinder is removed from the press unit and replaced by the second plate cylinder. Alternatively, the first plate cylinder is modified to become the second plate cylinder.

There is also described herein a retrofitted folding apparatus comprising: an existing folder having: a two-around cutting cylinder, a three-around pin/collect cylinder, and a three-around jaw folder; all of which have previously been removed; a replacement three-around cutting cylinder; a replacement five-around pin/collect cylinder; and a replacement five-around jaw folder; wherein the replacement three-around cutting cylinder, the replacement five-around pin/collect cylinder, and a replacement five-around jaw folder are placed on the existing folder without altering its footprint.

In another embodiment the apparatus further comprises a four-around female cutting cylinder arranged between the three-around cutting cylinder and the five-around pin/collect cylinder.

There is also described herein a method of reducing the cut-off length of an existing press unit, the method comprising: replacing a first plate cylinder of the press unit with a corresponding second plate cylinder of the same length and diameter as the first plate cylinder but printing an odd number of pages generally greater than or equal to three pages while making no further modifications to the press unit; printing pages on the press, the printing comprising running the press at the same speed it had run prior to the replacing; and utilizing a four cylinder folder to provide for cutting and folding the pages; wherein the first plate cylinder comprises a first number of plates equally distributed around the circumference of the first plate cylinder; and wherein the second plate cylinder comprises a second number of plates equally distributed around the circumference of the second plate cylinder, the second number being greater than the first number.

In an embodiment of the method, the first number of plates is two and the second number of plates is three. The method may further comprise replacing a first blanket cylinder in the press unit with a second blanket cylinder cooperative with the second plate cylinder. It may additionally or alternatively comprise removing the first plate cylinder from the press unit. It may additionally or alternatively comprise operating the press unit with the second plate cylinder installed, wherein each of the plates on the second plate cylinder transfers ink to a sheet.

In an embodiment of the method, the first plate cylinder is one in a plurality of the first plate cylinders, the method further comprising repeating the replacing for each of the first plate cylinders in the plurality.

There is also disclosed herein an apparatus for printing, the apparatus comprising: an existing press unit comprising a first plate cylinder which is removed; a replacement second plate cylinder for receiving ink, the second plate cylinder comprising at least three plates and having the same diameter and length as the first plate cylinder and being installed in the press unit; a blanket cylinder for transferring the ink from the second plate cylinder to paper; and a folder. In an embodiment of the apparatus, the second plate cylinder comprises three plates. The second plate cylinder may be a three-around plate cylinder. In an embodiment of the apparatus, each of the plates receives an image and transfers the image to the blanket cylinder; the blanket cylinder transfers each of the images to paper; and the folder cuts the images apart.

In a further or alternative embodiment, the second plate cylinder further comprises: a first end; a second end; a first section corresponding to the first end, the first section comprising a first number of plates; and a second section corresponding to the second end, the second section comprising a second number of plates. Also disclosed herein is a replacement three-around plate cylinder. In a further embodiment, the cylinder comprises a first end; a second end; a cylindrical shaft between the first end and the second end, the shaft having a circumference; the shaft further comprising at least three plates covering the shaft, each of the plates occupying an equal portion of the circumference. In a further embodiment, the equal portion comprises an arc of 120°.

Also disclosed herein is a system for reducing the cut-off length of an existing press unit, the system comprising: the press unit further comprising a first plate cylinder; the first plate cylinder further comprising a first number of plates equally distributed around the circumference of the first plate cylinder; a second plate cylinder of the same length and diameter as the first plate cylinder; the second plate cylinder further comprising a second number of plates equally distributed around the circumference of the second plate cylinder; wherein the second plate cylinder replaces the first plate cylinder.

In an embodiment of the system, the first number of plates is two and the second number of plates is three. The press unit may further comprise a first blanket cylinder, wherein the first blanket cylinder is replaced with a second blanket cylinder cooperative with the second plate cylinder. The first plate cylinder may be one in a plurality of the first plate cylinders; the second plate cylinder is one in a plurality of the second plate cylinders; and each first plate cylinder in the plurality is replaced with a second plate cylinder in the plurality.

Also disclosed herein is a method of reducing the cut-off length of an existing press unit, the method comprising replacing a two-around plate cylinder of the press unit with a three-around plate cylinder, the three-around plate cylinder having the same diameter and length as the two-around plate cylinder; making no further modifications to the press unit; printing pages on the press, the printing comprising running the press at the same speed it had run previously; and utilizing a 3:5:5 or 3:4:5:5 folder to provide for cutting and folding the pages.

Also disclosed herein is a method of shortening a dimension of a printed medium, the method comprising: having a press unit capable of printing the medium, the press unit comprising a first plate cylinder; and replacing the first plate cylinder of the press unit with a corresponding second plate cylinder of the same length and diameter as the first plate cylinder; wherein the first plate cylinder comprises a first number of plates equally distributed around the circumference of the first plate cylinder, the arc of each of the plates corresponding to the dimension; and wherein the second plate cylinder comprises a second number of plates equally distributed around the circumference of the second plate cylinder, the arc of each of the plates corresponding to the dimension.

In shortening the cut-off length without substantial adjustment to the press unit, it is also desirable to accommodate the cut-off length while cutting and folding the sheets without substantial adjustment.

There is also disclosed herein an apparatus for printing, the apparatus comprising: an existing press unit comprising a first plate cylinder which is removed; a replacement second plate cylinder for receiving ink, the second plate cylinder comprising at least three plates and having the same diameter and length as the first plate cylinder and being installed in the press unit; a blanket cylinder for transferring the ink from the second plate cylinder to paper; and a folder. The folder may be any of a 3:5:5 folder, a 2:4:4:4 folder, a 3:3:5:5 folder, a 4:4:5:5 folder, a 2:4:5:5: folder, a 3:4:5:5 folder, a 3:5:5 folder or a 4:5:5 folder.

In an embodiment of the apparatus, the second plate cylinder comprises three plates. The second plate cylinder may comprise a three-around plate cylinder. In an alternative or further embodiment of the apparatus, the folder comprises: a two-around cutting cylinder; a five-around pin/collect cylinder; and a five-around jaw cylinder. In an embodiment, this may be a 4:4:5:5 folder in applications without space comments or a 3:4:5:5 folder where space may be limited.

In an embodiment, the folder performs straight-run operation. In an alternative embodiment, the folder performs collect-run operation, the apparatus further comprising a skip slitter, the skip slitter being calibrated to the second plate cylinder.

In an embodiment of the apparatus, the folder comprises: a five-around folding cylinder; and a three-around cutting cylinder.

In an embodiment, the folder is converted from performing collect-run operation to performing straight-run operation. The folder may be a rotary folder, jaw folder, or pinless folder.

Also disclosed herein is a method of folding a medium printed by a three-around plate cylinder, the method comprising running the medium through a 3:5:5 folder. In an embodiment of the method, the running comprises running the medium between a first cylinder and a second cylinder, the first cylinder and the second cylinder being in a ratio of circumference of 3:5. In a further embodiment, the first cylinder is a cutting cylinder and the second cylinder is a pin/collect cylinder; and the method further comprising transferring the medium from the pin/collect cylinder to a jaw cylinder; wherein the pin/collect cylinder and the jaw cylinder are in a ratio of circumference of 1:1.

In an embodiment of the method, the first cylinder is a cutting cylinder and the second cylinder is a folding cylinder. The medium may be newspaper.

Generally disclosed herein are folders or folding units for press units that have been adapted to print three pages per rotation of the plate cylinder.

DESCRIPTION OF PREFERRED EMBODIMENT(S)

Figure 1:
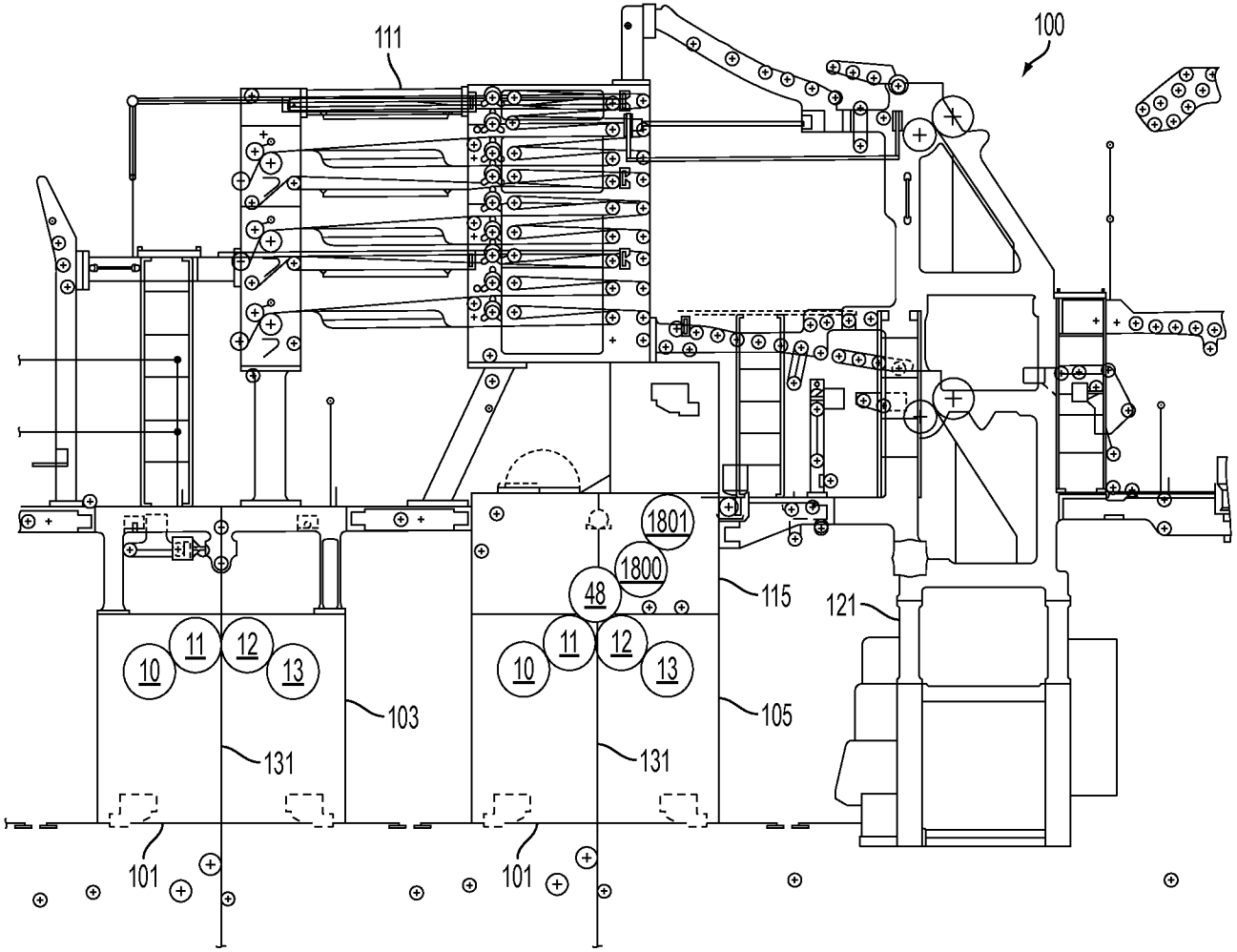
FIG. 1 PRIOR ART
FIG. 1 provides a drawing of a portion of a pressline showing two printing units (a three color unit and a standard unit) as well as a folder and some of the angle bars for interacting with the paper web.

Generally disclosed herein are systems and methods for reducing the cut-off length of a newspaper, wherein a plate cylinder that generates images for two sheets is replaced with a plate cylinder of the same diameter and length that generates images for three or more sheets, and the press unit is operated with the latter cylinder. There is also described a folder designed to work with such a press, and methods for utilizing such a pressline in a three-around print mode. Generally, the press units and folders discussed herein will be generated by retrofitting an existing press unit or folder to carry out printing in a three-around mode, while maintaining the same footprint as the original press unit.

To refer to differently sized printings this disclosure will refer to printing in a two-around mode, a three-around mode, etc. This is to indicate that during each rotation of a plate cylinder a press unit (101) is printing either two or three pages with a page being defined as an image split from other images in the resultant paper, but printed on the same web. These images may be duplicated down the web, or different from images above or below, providing for a repeating series. Further, this disclosure will discuss a one-around, two-around, three-around, etc. cylinder. This is a cylinder for printing, cutting, or transporting pages. This reference will generally be used in conjunction with a plate cylinder where the number refers to the number of plates, or a cutting or transport cylinder where it refers to the number of pages (images) which would fit around the cylinder.

It should be recognized that a plate cylinder can operate in any mode which is a multiple of the number of plates or the cylinder by printing more than one image per plate. So for example, a one-around cylinder may operate in a one-around mode, a two-around mode, a three-around mode, etc. by simply having each plate (in this case each full rotation) comprise 1, 2, 3, etc. pages with appropriate space between them for cutting. Similarly, a three-around cylinder can operate in three-around, six-around, nine-around, etc. mode in the same fashion.

The systems and methods will be discussed in terms of their application principally to a standard press unit (103) and may occasionally be expanded to a half deck (105) for integration on the standard press unit to apply the systems and methods to a three color unit. One of ordinary skill in the art would understand that the techniques could also be applied to other standard units, half deck units, full deck units, three color units, four color units, and/or tower units utilizing the same principles and without undue experimentation. The systems and methods here may in fact be used to provide for three-around mode printing by any press unit which utilizes printing cylinders retrofitted, modified or otherwise constructed in conjunction with the systems and methods discussed herein. More generally, while the disclosure refers to press units and components thereof related to newspaper printing, one of ordinary skill understands that the disclosure may apply to any printing application, including on any publication, paper, fabric, or other desired medium. Further, it may apply to any process or structure wherein the circumference of cylinders, drums, or rollers, and arcs of portions thereof, corresponds to a dimension of a final product which is desired to be adjusted.

To begin the discussion it is best to first look at the design of a pressline in a standard newspaper press floor. FIG. 1 shows a general layout of a portion of an exemplary pressline (100) as might be used in any major newspaper to print pages which are primarily black and white with so-called "spot" color or occasional full color pages. The pressline (100) includes at least one press unit (101), a series of angle bars (111) and a folder (121). While the pressline of FIG. 1 shows two press units (101), the angle bars (111) and a single folder (121); most presslines will have a folder (121) and two sets of angle bars (111) with between 4 press units (101) to 10 press units (101) depending on the desired capacity and design of the pressline (100). Further, a single press room may have one or more than one pressline (100), again depending on capacity and design, which may operate independently, or may operate in conjunction with each other. For the purpose of this disclosure, it will be presumed that the pressline (100) include at least one press unit (101) and any other associated structure necessary which operates in the standard manner known to those of ordinary skill in the art.

Figure 2:
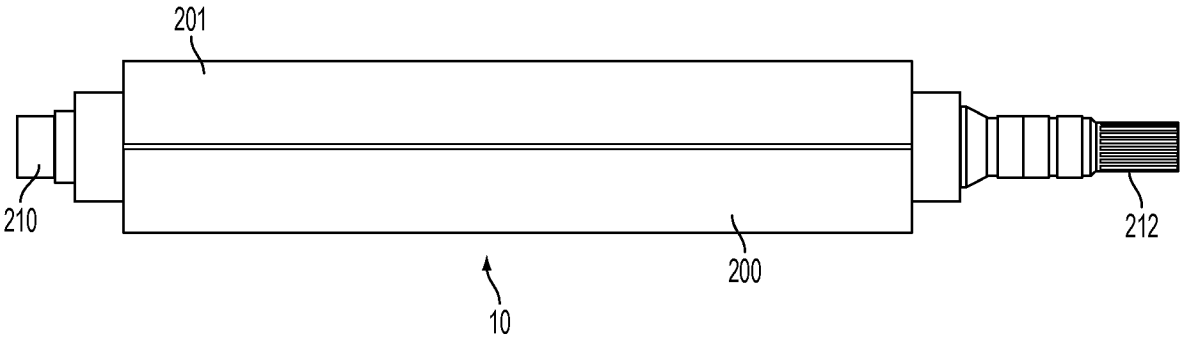
FIG. 2 PRIOR ART
FIG. 2 provides a drawing of a prior art two-around plate cylinder.

The press unit (101) described herein and shown in FIG. 1 may be described as having a two-around plate cylinder, an example of which is shown in FIG. 2. In many press units (101), plate cylinders (10) or (13) commonly produce two images corresponding to two sheets of the same length per rotation, by having two images inked onto them, one per plate. The cylinder (10) or (13) then rotates continuously printing the combined pattern of two pages in a repeated serial pattern.

The embodiment of FIG. 2 shows an embodiment of such a two-around plate cylinder (10), representative of any two-around plate cylinder (10) (13). As shown, a two-around plate cylinder (10) has two plates (200) (201) on a shaft between an operator side (210) and drive side (212). Each plate (200) (201) comprises half the circumference of the shaft of the cylinder (10). The plates (200) (201) are equally distributed around the circumference of the cylinder (10), in equally sized arcs. The plates (200) (201) are generally in a covering relationship to the cylindrical portion of the cylinder (10). As shown in FIG. 2, the plates (200) (201) generally wrap around the external curved surface of the cylinder (10). Each plate (200) (201) corresponds to an image, which in turn generally corresponds to a single sheet of a newspaper, the sheets being ultimately separated by the end folder (121) and creating two separate sheets.

The cut-off length of each sheet corresponds to the arc length of the cylinder (10) occupied by the plate (200) (201) corresponding to the image for that sheet. Where a two-around plate cylinder (10) has a circumference of 64", by way of non-limiting example, operation of a press comprising that two-around plate cylinder (10) may generate images on two sheets 32" in length. Commonly, two-around plate cylinders have a 47" circumference; such a cylinder would generate images on two sheets 23½" in length.

The press units (101) may be any type of press unit (101) but will generally be either standard units (103), three color units (105) (which is usually a standard unit (103) with a half deck unit (115) placed thereon), four color units (which is usually a standard unit (103) with a full deck or satellite unit comprising a common impression cylinder (not shown) placed thereon) or tower units (not shown). The type of press unit (101) depends upon the flexibility originally built into the pressline (100). A pure black and white pressline (100), for instance, will generally only have standard units (103), while a pressline (100) utilizing some color (spot or process color) may have some three color units, four color units and/or towers. Full color presslines or presslines designed to be highly versatile, may comprise all tower press units.

Regardless of the exact press units (101) used, the pressline (100) will generally operate in a similar fashion. Paper (131) will be fed from a paper roll to the press units (101) generally from underneath the press units (101). The paper (131) will be of a predetermined width and will generally be provided on a large diameter roll containing a length many times greater than the height of any particular newspaper page. The page will generally be printed upright so that if the roll of paper is viewed before cutting, there will be a predetermined number of pages arranged side to side across the width of the roll, with the same pages repeated serially down the roll as it unwinds and is printed. However, pages may alternatively be printed horizontally (generally called "tabloid" printing). The exact width of the paper roll is selected based on the width of the press unit (101) and the desired size of the resultant pages.

As the paper (131) comes up through the press unit (101), ink and dampener solution are transferred from various troughs or other storage devices onto a series of transfer rollers. Eventually the ink and dampener solution are applied to a plate cylinder (10) or (13). While the term "cylinder" is used for some components while "roller" or "drum" is used for others, this is done for convenience and does not imply any structure to any component which could not be encompassed through the use of a different term. Plate cylinder (10) or (13) includes the necessary structure to allow for the ink to be placed into the correct format so as to form the necessary text or images to be printed. This may be the actual shape to be printed or may be a reverse image (depending on the type of printing performed). This structure will generally be on the plates (200) and (201) with each plate corresponding to each image. The plate cylinder (10) or (13) then transfers the ink to blanket cylinder (11) or (12) which then transfers the ink to the paper (131) printing the page. Both sides of the page are generally printed simultaneously by the two blanket cylinders (11) and (12) in a standard press unit (103). If a three color press unit (105) is used, the paper (131) may be routed to an additional plate cylinder (1801) and blanket cylinder (1800).

It is important to note that the reference numbers chosen for the plate (10), (13), and (1801) and blanket (11), (12), and (1800) cylinders in this disclosure were specifically chosen. Various references related to these cylinders utilizing these same reference numbers are known in the industry. Therefore, the choice of reference and depicted side implies which side of the press unit (101) is being viewed. While the systems and methods can obviously be reversed if the system is being accessed from a different side, this use of reference numbers does help to provide for a particular indication of particular structure as generally no other distinguishing characteristics of the press unit are used. In the case of FIG. 1 the choice of reference numbers shows that the view is from the operator side of the press.

Generally the printing is accomplished by ink being transferred from the blanket cylinder (11), (12), or (1800) to the paper (131). In order to print cleanly, the paper (131) cannot be suspended over the blanket cylinder (11), (12) or (1800), but the blanket cylinder (11), (12), or (1800) must be allowed to push against a surface (generally another revolving cylinder) to transfer the ink to the paper (131) and cleanly print the page. In the standard press unit (103), the two blanket cylinders (11) and (12) push against each other printing both sides of the page simultaneously with each cylinder creating the surface for the other cylinder to push against. In the three color unit (105), there is included a common impression cylinder (48) which may be pressed against by any or all of the blanket cylinders (11), (12), or (1800) to provide the necessary surface.

Once the paper (131) has been printed by any particular press unit (101), it may be routed through additional press units (101) (or may go back through the same press unit (101)) to add additional color or colors by contacting another blanket cylinder (11), (12), and (1800). In this way each cylinder effectively prints a single set of pages on the paper web. This may either be provided in black or may be one of three component colors which, when used together, produce a full color image.

Eventually the paper web will be routed through the angle bars (111). These angle bars (111) provide for various changes in direction, orientation and/or delay in the various rolls of paper (131). As each roll of paper (131) is printed to become a collection of pages repeated serially, in order to form a newspaper having many different pages, the pages being printed by a first press unit (101) are generally different from the pages being printed by a second press unit (101). The angle bars (111) may also include cutting instruments to separate the sheets and/or pages printed side by side, effectively narrowing the width of the paper web where necessary. The primary purpose of the angle bars (111) is to arrange the various individual paper webs with each other so as to align the components of the resultant newspaper correctly. Generally, when the paper (131) leaves the angle bars (111) the various rolls have been arranged with their major surfaces over each other, and with different pages arranged over top of each other so that numerical ordered pages are logically arranged. Further, the repetitions of one paper roll (131) are aligned with the repetitions of the other paper rolls (131) and each roll is split to only one page wide.

The paper rolls (131) are then fed into the folder (121) which cuts the individual newspaper or newspaper sections apart and folds then into sections. In particular, the folder (121) separates the individual newspaper sheets from the web of sheets all arranged on the series of rolls (131).

When the final publication is in "broadsheet" form, wherein longer vertical pages are divided by a vertical fold, and wherein the entire publication is then horizontally folded, the paper web (131) may be drawn over a side folder to introduce the vertical fold, which may be referred to as a "first fold," in parallel with the paper web (131). This effectively folds all the sheets in the paper web and the adjacent webs to produce what we may think of as a paper "book."

Figure 3:
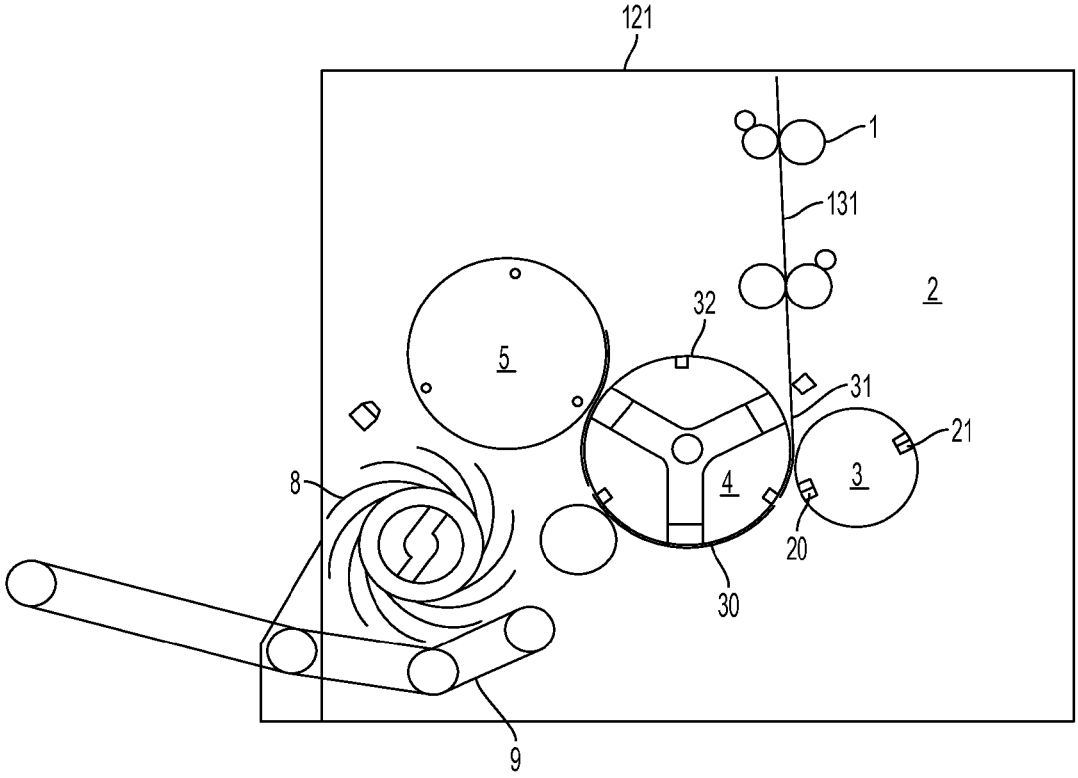
FIG. 3 shows an embodiment of a prior art jaw-type end folder in a 2:3:3 ratio.

The paper rolls (131) are then fed into the end folder (121) (or more commonly simply called the folder) which introduces the horizontal, "second fold" across the paper web (the center page fold) and cuts the individual newspaper or newspaper sections apart. In particular, the end folder (121) separates the individual newspaper sheets from the web of sheets all arranged on the series of rolls (131) producing a newspaper section. An embodiment of one type of end folder (121), a jaw folder, is shown in FIG. 3. The paper (131) is first fed between a cutting cylinder (3) and a pin/collect cylinder (4) to cut the papers apart. The cutting cylinder (3) may be described as "two-around," in that it has two blades (20) (21). The blades (20) (21) cut the paper (131) when they rotate past the pin/collect cylinder (4). The length of the sheet ultimately cut is therefore equal to half the circumference of such a two-around cutting cylinder (3) and corresponds to the height of the paper. The circumference of the pin/collect cylinder (4) is therefore calibrated to move two sheets (30) (31) past the cutting cylinder (3) for every rotation of the cutting cylinder (3), and to have some empty space (32) to round out the rest of the pin/collect cylinder's (4) circumference. The pin/collect cylinder (4) in FIG. 3 accomplishes this by being three-around; that is, each sheet (30) (31) occupies a 120° arc around the circumference of the pin/collect cylinder (4), and 120° is left unoccupied (32) to permit a full rotation. Since pin/collect cylinder (4) is of larger diameter than cutting cylinder (3), each handles pages of similar size although they hold a different number of them.

Once the sheets are cut, they are then transferred to the jaw cylinder (5) for tenting or creasing and introduction of the second fold. This cylinder (5) handles the same number of sheets as the pin/collect cylinder (4). In the end folder (121) of FIG. 3, the jaw cylinder (5) is, therefore, also three-around. The jaw cylinder (5) then passes the tented sheets to a delivery fly (8) for completion of folding and placement on a conveyor belt (9).

The end folder (121) has been traditionally designed to be able to process the paper (131) as it is released from processing by a two-around plate cylinder (10). For a press unit (101) with a two-around plate cylinder (10), a functional end folder (121) may resemble that shown in FIG. 3, which runs in a 2:3:3 ratio as discussed. That is, the cutting cylinder (3) is two-around, the pin/collect cylinder (4) is three-around, and the jaw cylinder (5) is three-around. This ratio is keyed to the sheets from a press unit (101) printing in two-around mode, as it can handle two sheets (30) (31) at a time with space equivalent to a third sheet (32) to permit rotation completion without the cylinders interfacing with sheet transfers. Traditionally, two-around mode has been the only common mode of operation. Thus, existing presses (101) utilize two-around plate cylinders (10) and a folder (121) with a two-around cutting cylinder (3) standard to allow for easy integration.

Figure 4C:
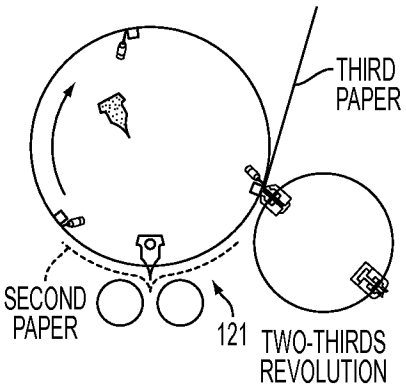
FIG. 4C PRIOR ART
FIGS. 4A-4C show the general principles of straight-run operation in time lapse.
Figure 4B:
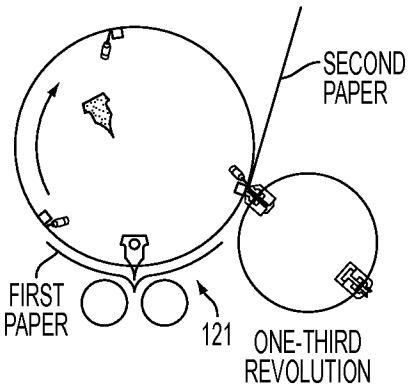
FIG. 4B PRIOR ART
Figure 4A:
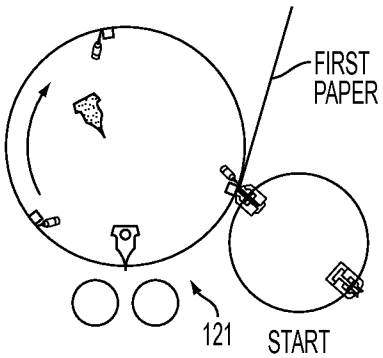
FIG. 4A PRIOR ART
Figure 4D:
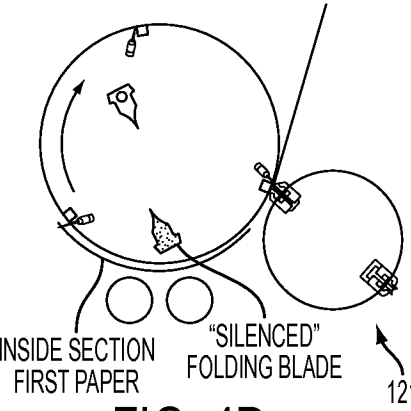
FIG. 4D PRIOR ART
FIGS. 4D-4I show the general principles of collect-run operation in time lapse.
Figure 4E:
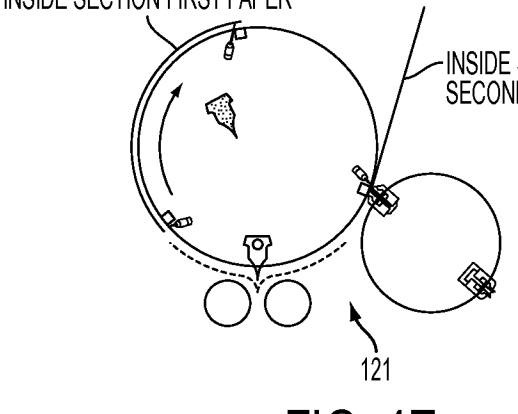
FIG. 4E PRIOR ART
Figure 4F:
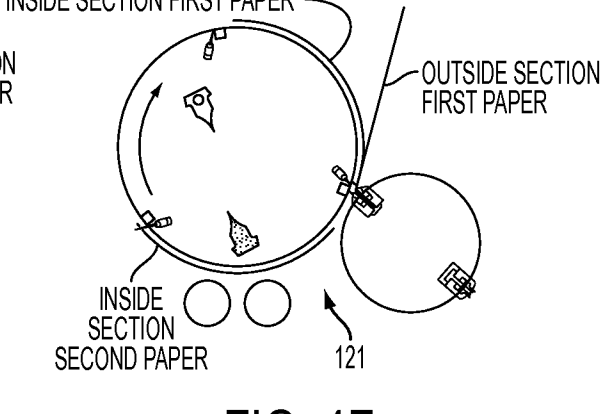
FIG. 4F PRIOR ART
Figure 4G:
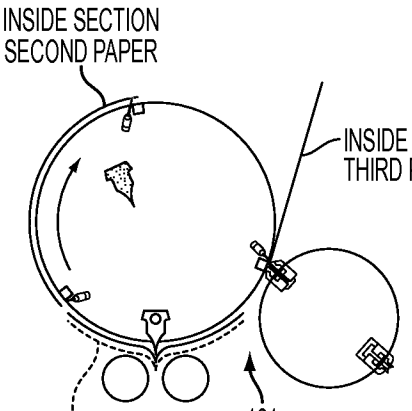
FIG. 4G PRIOR ART
Figure 4H:
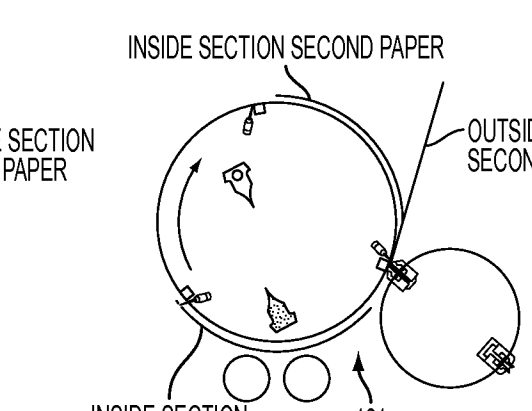
FIG. 4H PRIOR ART
Figure 4I:
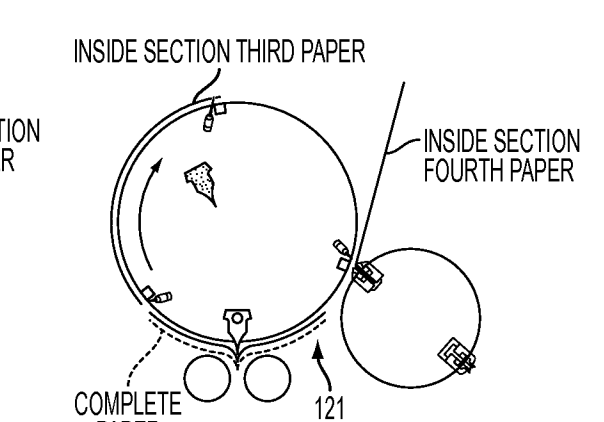
FIG. 4I PRIOR ART

Generally, folders (121) have operated in one of two ways, which may be referred to as "straight run" or "collect run." In straight run operation, the number of completed products, or sheets, is equal to the number of plates on the plate cylinder (10). Where there are two plates, straight run operation generates two completed products for every revolution of the printing cylinder. An embodiment of this operation is shown in FIGS. 4A through 4C. In contrast, collect run operation produces one completed product for every revolution of the printing cylinder. In collect run operation, the folder (121) stores a first product from the plate cylinder revolution until a second product is produced, and then collects the two products together and releases them. An embodiment of this operation is shown in FIGS. 4D through 4I.

As should be apparent from the above, in traditional press systems, the plate cylinders were almost universally set up to provide for two-around printing. The reasoning is apparent from simple metrics. If one is aiming for a sheet around 23" in length a one-around cylinder would be small (around 7" in diameter), while a two-around cylinder would be a more manageable size (around 15" in diameter), while a larger cylinder could become unmanageably large (around 20" in diameter or larger). Further, it should be apparent that in standard operation a plate cylinder needs an even number of (and preferably 2) pages to interact with the folder, if an uneven number of pages are printed serially on the web, the folder (121) will be unable to collect run the pages as the sections produced would have different pages in each rotation at the cutting cylinder (3). When using two plate cylinders in a single press, two images will always line up regardless of the direction of rotation.

In the systems and methods disclosed herein, one or more two-around plate cylinders (10) (13) are replaced with a corresponding cylinder that may be referred to as a three-around plate cylinder (400). The three-around plate cylinder (400) corresponds in that it is a structural substitute for the two-around plate cylinder (10) as it is used in the particular press unit (101) of which it is a component. While printing in a three-around mode can be accomplished by a three-around plate cylinder (400) which has three plates as shown in FIG. 5, it may also have only one plate as shown in FIG. 6. In the one-plate cylinder (600) embodiment, the plate will generally be logically subdivided to provide for printing of three sheets. Therefore, even though it technically only has one plate, it is still for printing in three-around mode.

Figure 5C:
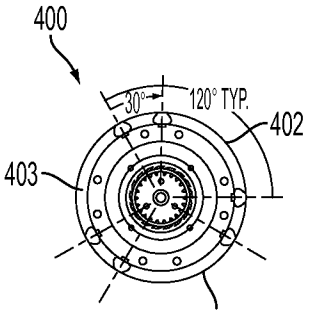
FIG. 5C provides a cross-section of an embodiment of a three-around plate cylinder.
Figure 5A:
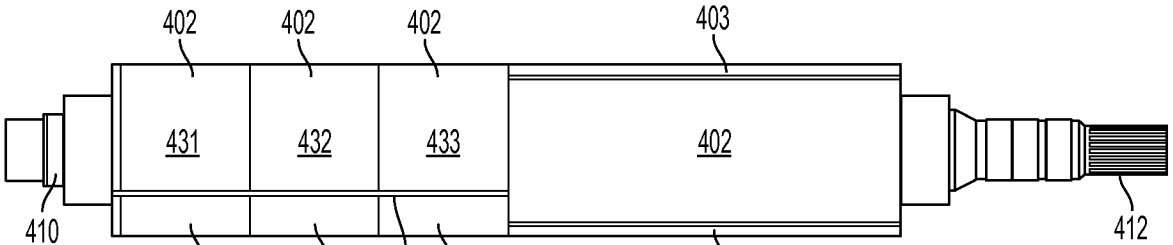
FIG. 5A provides a lateral perspective of an embodiment of a staggered three-around plate cylinder.
Figure 5B:
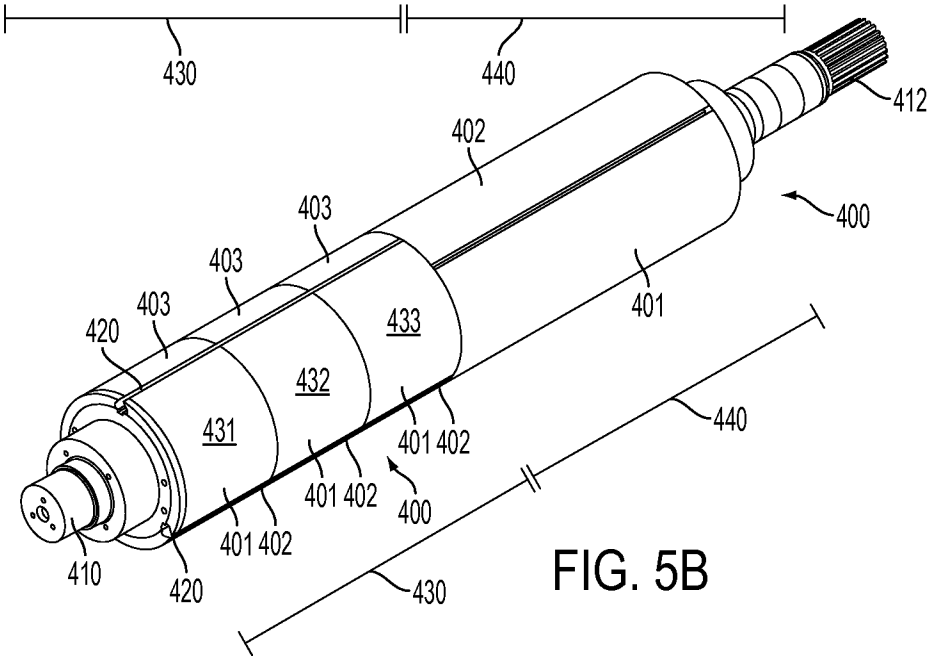
FIG. 5B provides an aerial-lateral perspective of an embodiment of a staggered three-around plate cylinder.
Figure 6:
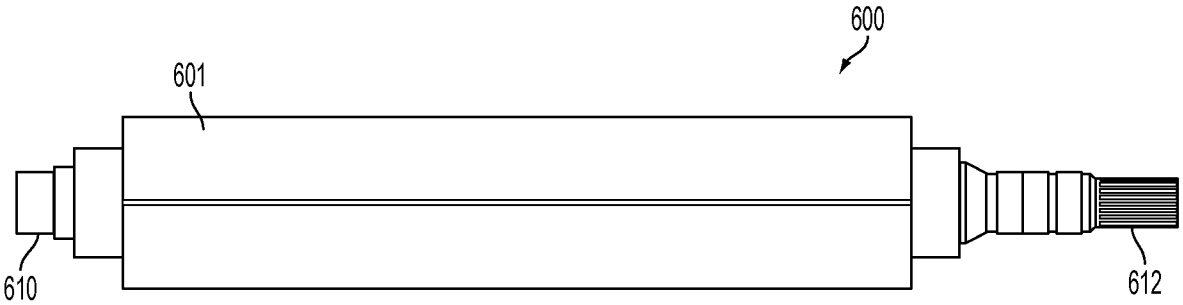
FIG. 6 shows a straight-across one-around plate cylinder.

FIGS. 5A through 5C show an embodiment of a three-around plate cylinder (400) comprising an operator side (410), a drive side (412), and a shaft therebetween. The three-around plate cylinder (400) is generally cylindrical, as fitting its roller function. At one end of the cylinder (400) is a drive side (412) where it engages the press unit (101); at the other end is an operator side (410) which is generally free rotating in a support.

Covering the rounded surface of the shaft of the cylinder (400) are plates (401) (402) (403), each comprising an equal portion of the circumference of the cylinder (400). In other words, the plates (401) (402) (403) are equally distributed around the circumference and have equal arcs. In an embodiment, there are three such plates (401) (402) (403), each occupying a 120° arc along the circumference of the plate cylinder (400).

The plates (401) (402) (403) may be mounted to the cylinder (400) by use of mounting slots (420). The slots (420) may comprise and be tailored to plate lockup devices chosen according to the requirements of the particular press unit (101) in which the cylinder (400) is going to be installed.

In the embodiment of the various parts of FIG. 5, the plates (401) (402) (403) may be in two or more sections in which the plates (401) (402) (403) in each section are circumferentially staggered relative to plates (401) (402) (403) in the other section(s). In FIGS. 5A and 5B, the plates (401) (402) (403) in section (430) are staggered relative to the plates (401) (402) (403) in section (440). Therefore, as the cylinder (400) rotates, the plates in section (430) are at a different stage in printing than the plates in section (440). This embodiment may operate with a staggered blanket cylinder (11) (12), which may be common in many older press units (101). This arrangement means that the two "sub-webs" which are being printed side by side, are at different points in printing at any time.

In an alternative embodiment, the cylinder (400) may have two sections of plates in which the plates (401) (402) (403) are circumferentially straight across relative to each other. In FIGS. 5A and 5B, section (430) shows three columns (431) (432) (433) of plates (401) (402) (403) that are straight across relative to each other. Therefore, as section (430) rotates, the plates in columns (431) (432) (433) are all at the same stage in printing while plates in section (402) for example are all offset. Such an embodiment comprises a continuous mounting slot (420).

One of ordinary skill understands from FIGS. 5A through 5C that a three-around plate cylinder (400) may combine any number of sections (430) and (440), or have an entire cylinder (400) embodying only section (430) or (440). That is, a three-around plate cylinder (400) may embody entirely section (430), having multiple columns (431) (432) (433) with straight across plates. In a preferred embodiment, such a cylinder (400) has six columns, permitting printing six narrower pages from the cylinder (400). Alternatively, a three-around plate cylinder (400) may comprise multiples of section (440), with multiple columns of staggered plates (401) (402) (403). Any combination of sections (430) and (440) is also contemplated, as informed by the blanket cylinder (11) (12), the number of pages desired to be printed per cylinder (400), or any other factor.

In an alternative embodiment, it is not required that the three-around cylinder actually have three separate plates. Instead, the cylinder (400) may have only a single plate (or two offset plates each one corresponding to offset plates (430) and (440)) in FIGS. 5A through 5C. This single plate can then be logically divided into three pages. In this embodiment, effectively instead of having three plates, each with one page thereon, there is a single plate with three pages thereon. This embodiment is discussed in more detail later.

A two-around plate cylinder (10) and its three-around plate cylinder (400) replacement may have the same length between the operator side (410) and drive side (412). Because the diameter, length, and most importantly circumference are generally the same between a three-around plate cylinder (400) and corresponding two-around plate cylinder (10) which it is designed to replace, the three-around plate cylinder (400) may replace the two-around plate cylinder (10) (13) without alteration of the dimensions of the press (101) or mode of cylinder attachment to the press (101) in any way. In a preferred embodiment, the press unit (101) comprising a replacement three-around plate cylinder (400) is operated at the same speed as it did when it comprised a two-around plate cylinder (10). Three pages are produced in the same amount of time as two were previously produced, thus increasing the productivity and rate of production without increasing the speed at which the press unit (101) is actually operated.

The three-around plate cylinder (400) may also rotate at the same rate as the two-around plate cylinder (10) (13), and may approximate the mass of the two-around plate cylinder (10) (13), permitting full integration into the press unit (101) and its operation without significant adjustment. In such embodiments, a three-around plate cylinder (400) generally has the same newsprint speed dynamics as a two-around plate cylinder (10). Replacement with a three-around plate cylinder (400) is also facilitated by the fact that cylinders are generally designed to be removable.

It should be apparent that operating a press unit (101) with a three-around press cylinder (400) at the same speed an original two-around plate cylinder was operated allows the press to produce 50% more documents than before. Specifically, in the same time, both cylinders accomplish one rotation, however, the two-around only produces two sheets while the three-around produces three. While this is a desirable outcome, it is also possible for the printing press unit to now produce 50% more color than previously. Specifically, the additional sheet per rotation need not be a complete sheet but may be a component color sheet. This can allow a modified pressline to actually print color where it may have been unable to before. Just to show a simple example, if one takes 8 units, each producing four pages, the paper could produce 32 black and white pages, 16 black and white pages and 4 color pages or 8 color pages. With the same line utilizing three-around cylinders, the unit could produce 48 black and white pages, 24 black and white pages and 6 color pages, or 12 color pages. Therefore, the press owner has the ability to add paging, color, or a combination of both when operating the press using three-around cylinders.

The three-around plate cylinder (400) will generally be used to retrofit an existing press unit (101) comprising two-around plate cylinders (10) (13) by replacing these with three-around plate cylinders (400). Such retrofitting also permits lowering the cut-off length (thereby permitting greater productivity and saving paper) without investing in a new, extremely expensive press unit (101). Replacement may be accomplished by any desirable or appropriate means, limited only by the means by which the cylinders are secured to the press unit (101). One of ordinary skill will know how to most efficiently and effectively remove the two-around plate cylinder (10) (13) and replace it with a three-around plate cylinder (400). Means for connecting the three-around plate cylinder (400) may be the same as the means for connecting the two-around plate cylinder (10) (13), or may be improved or otherwise modified. In retrofitting to replace the two-around probe cylinder (10) the three around plate cylinder (406) may be a new cylinder which is effectively a drop in substitute for the two-around cylinder (10), or the two-around cylinder may be modified (e.g. such as by being replated) to make it into a three-around cylinder (400).

In the context of the press unit (101) or a three-around cylinder (400), each of these plates (401) (402) (403) corresponds to an image for a sheet ultimately separated from each other by the folder (121) and resulting in three separate sheets. Each plate (401) (402) (403) is inked with an image that is transferred to the blanket cylinder (11) (12) and ultimately to the roll of paper. The cut-off length of each sheet corresponds to the length of the image transferred originally from the plate (401) (402) (403) as the cylinder rolls along the length of the paper. Thus, the cut-off length is dictated by the arc of the circumference of the cylinder (10) occupied by the plate (401) (402) (403) corresponding to that sheet.

A three-around plate cylinder (400) replacing a two-around plate cylinder (10) will generally have the same diameter as the two-around plate cylinder (10). Because of this, the addition of additional plates (401) (402) (403) on a three-around plate cylinder (400) over a two-around plate cylinder (10) cuts the same circumference into smaller arcs. Therefore, the cut-off lengths of the sheets generated by a three-around plate cylinder (400) are shorter than those of a two-around plate cylinder (10) of the same diameter. Where a three-around plate cylinder (400) has a circumference of 64", by way of non-limiting example, operating a press unit comprising such a cylinder (400) generates three sheets 21⅓" in length. Where a three-around plate cylinder (400) has a 47" circumference, such a cylinder would generate images on three sheets 15⅔" in length. These sheets generated by a three-around plate cylinder (400) are shorter in length than the sheets generated by a two-around plate cylinder (10) of the same diameter, thereby accomplishing a shorter cut-off length and saving paper. In an embodiment, the reduction is thirty-three percent.

The three-around plate cylinder (400) sheets are not so much shorter that substantial readjustment of content placement or length is necessarily required to accommodate the shorter length. A switch from a two-around plate cylinder (10) to a three-around plate cylinder (400) does not make it necessary to print additional sheets, which printing would make the newspaper longer and cancel out the paper savings accomplished by the shorter cutoff length, to accommodate this adjustment in length. Most of the reduction in length may correspond to a reduction in margins or the size of an advertisement: i.e., a "half-page" ad will still cover half a page, but will simply be smaller since the page is smaller. Similarly, in order to maintain relative dimensions of the resultant newspaper, the page width may be proportionally altered. This may be done by printing more pages across the width of the paper web (which can result in further increases in speed of printing) or by using a narrower web and subdividing accordingly.

For this reason, a three-around plate cylinder (400) is a preferred embodiment, although four-around plate cylinders and further subdivisions of plate cylinders are also contemplated and included as alternative embodiments herein. However, these additional plates, and the substantially shorter sheets they generate compared to a cylinder with fewer plates, may require additional adjustments to content that detract from the quality of the printed publication, or may require printing some extra pages that detract from the paper savings accomplished by the shorter cut-off length. Therefore, in alternative embodiments, the system and methods may retrofit a press with any replacement cylinder with additional plates that correspond to sheets with a shorter cut-off length than those produced by an existing plate cylinder, regardless of the number of plates the plate cylinder actually has after or before retrofit. However, for the most part the retrofitted plate cylinder will preferably have either three plates, or a single plate which is logically divided into three or more pages when used.

As previously discussed, it is not necessary to actually have three plates to print in a three-around mode. In an alternative embodiment a three-around mode may utilize a one-around plate cylinder (600) as shown in FIG. 6. This would comprise a single plate (601) arranged to cover the entire circumference of the cylinder (600) which again has an operator side (610), a drive side (612) and a shift therebetween. In this embodiment, the cylinder (600) technically prints only one "page" per rotation. However, it should be apparent that the one "page" can actually comprise 3 pages (images) arranged sequentially which would allow this physical cylinder (600) to operate in a three-around mode in identical fashion to a three-around plate cylinder.

The one-around plate (601) design can be particularly advantageous when a pressline is partially upgraded or is being upgraded over time while still operating. Since the one-around plate (601) can handle any length up to it's circumference, the one-around plate (601) may be arranged to print in a two-around mode initially. Since the diameter of the retrofit one-around cylinder is not changed from the initial two-around, this allows for the newly modified press unit (101) to continue to operate in a pressline (100) where the remaining units have not yet been upgraded and still include two-around plate cylinders (10). Once all press units (101) are upgraded, the press (100) line may then switch to three-around operation. Thus, the upgrade may be done in stages which may allow for the pressline (100) to not be taken out of operation while a retrofit occurs. For example, in one upgrade scenario, an eight press unit (101) pressline (100) could continuously operate on seven units with one being upgraded at any time. Each unit (101) would either comprise an unmodified two-around press unit (101) or a modified one-around press unit (101) printing in two-around mode. Once seven of the eight press units (101) are upgraded, the pressline (100) can then immediately commence operation in three-around mode (on seven presses) by simply having the one-around plate cylinders (600) now print in three-around mode. Since there are no two-around plate cylinders (10) remaining in use (the eighth being currently retrofitted) there is no need to operate the two-around mode. Once the retrofit is completed, a pressline having all one-around plate cylinders (600) can freely operate in any print mode, further increasing the functionality of the pressline (101).

In a further embodiment, depending on the structure, operation, or other features of the press unit (101), systems and methods for replacing a two-around plate cylinder (10) with a three-around plate cylinder (400) or one-around plate cylinder (600) may further comprise replacing the blanket cylinders (11) (12) with new blanket cylinders that cooperate with, or functionally interact with, the replacement three-around plate cylinders (400) or one-around plate cylinders (600). Such a blanket cylinder (11) (12) replacement may be desirable where it is desirable to expand the capacity to print in color. Such replacement may allow printing of multiple pages across each cylinder. In a preferred embodiment, such replacement allows color printing of six pages across which in turn allows a fifty percent increase in color printing capacity from a traditional four-across cylinder. It may not be necessary to replace blanket cylinders (11) (12) where the existing press unit (101) provides sufficient productivity in color printing.

It is also contemplated that newly manufactured press units (101) may comprise one or more three-around plate cylinders (400). However, it would be expected that new presses would simply be built with smaller two-around plate cylinders to produce pages of similar size. Therefore, the use of a three-around plate cylinder has particular value when used as part of a pressline retrofit because the three-around plate cylinder provides for a smaller cutoff without wasted paper and without the need to modify or replace existing press components. Further, because of the similarity in size, mass, etc., of the three-around (400), or one-around (600) cylinders, the retrofitted pressline can occupy the same footprint as its predecessor, utilize all of the same motor and clutch controls, and operate at similar mechanical speeds.

Part of the reason that new (as opposed to retrofitted) presslines would generally utilize smaller two-around plate cylinders instead of the three-around cylinders is because other units, such as folder (121) are traditionally constructed to operate with an even number of pages in each repetition per web. Even numbers are more easily divided and thus the use of three-around plate cylinders (400) can provide for more complicated mathematics in setting up the folding scheme. A switch from a two-around (10) to a three-around plate cylinder (400) will generally also require some other changes in the pressline (100) which are not immediately apparent.

Figure 11:
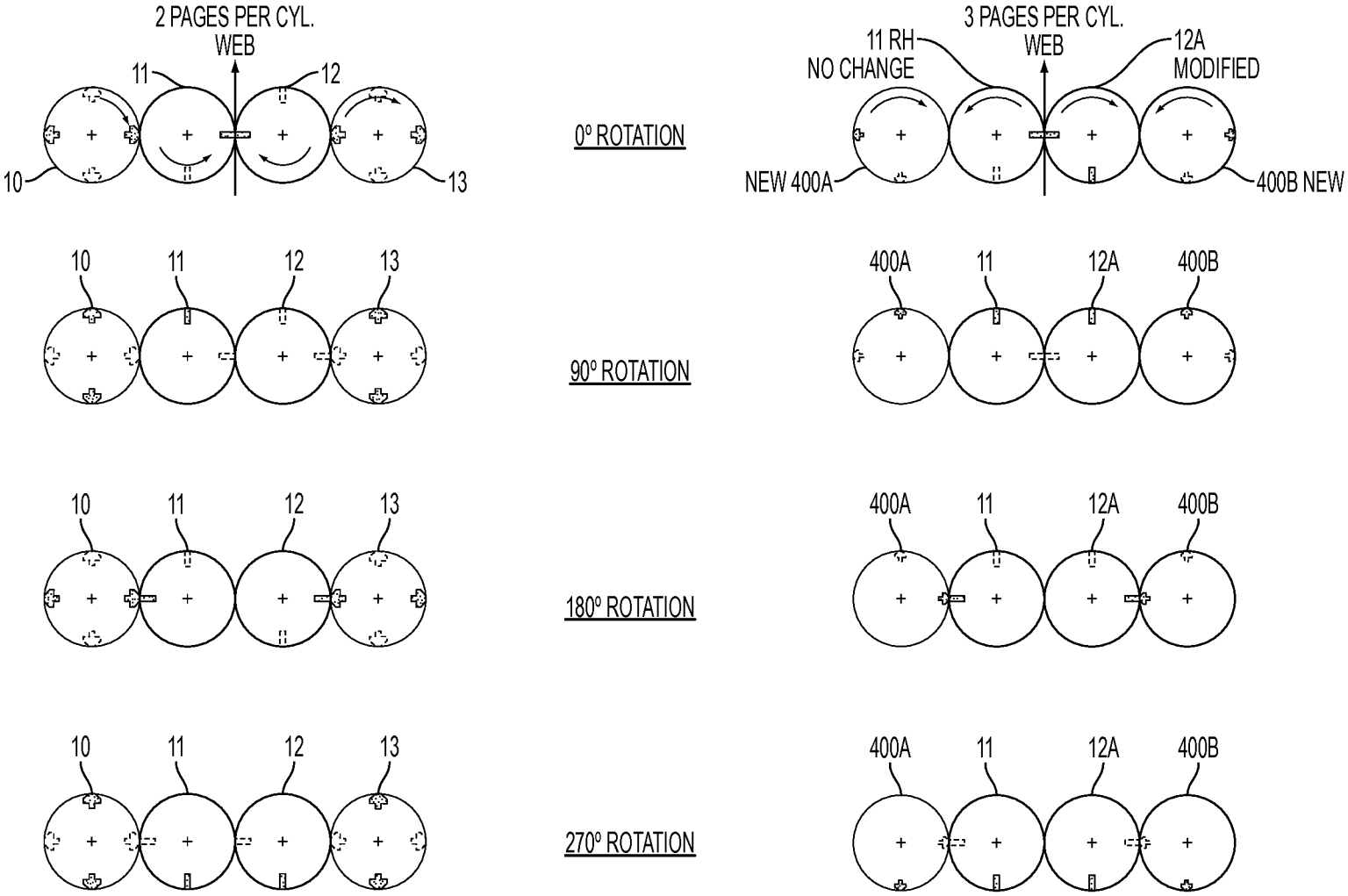
FIG. 11 shows a comparison of rotation for a two page standard press unit compared to a three page standard press unit showing why the handedness is necessary.

In the first instance when only a single page or two pages are being printed, the sheets are universally aligned between corresponding blanket cylinders. Specifically looking at press (103), the fact that cylinder (10) and (13) are counter rotating (one rotates clockwise, the other counter clockwise) does not matter. However, in a three-around system, it is necessary to introduce handedness in the plate cylinders (400). Looking at FIGS. 9A and 9B, plates on cylinder (400A) have to be arranged in a different order from plates on cylinder (400B) providing for the cylinders having a "handedness" specifically so as to align the pages on the plate cylinders (400A and 400B) with each other. For example, if cylinder (400A) had in order pages 1, 2, 3 when going clockwise, cylinder (400B) would generally have pages 3, 2, 1 in order when going clockwise. FIG. 11 shows how this works. This is as opposed to a two-around cylinder when both cylinders may have pages 1, 2 when going clockwise, with one plate cylinder (10) simply being offset by 180 degrees. Such changes can be further complicated when sections (such as sections (430) and (440)) are used. However, the changes follow the same general principles.

Figure 9A:
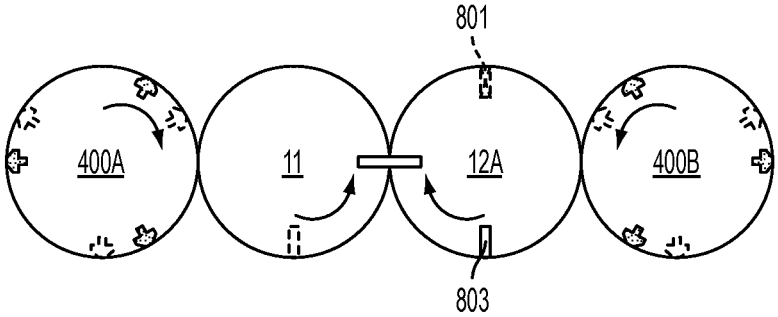
FIG. 9A shows an end view of the modification of a standard unit to introduce handedness when utilizing three-around plate cylinders.
Figure 9B:
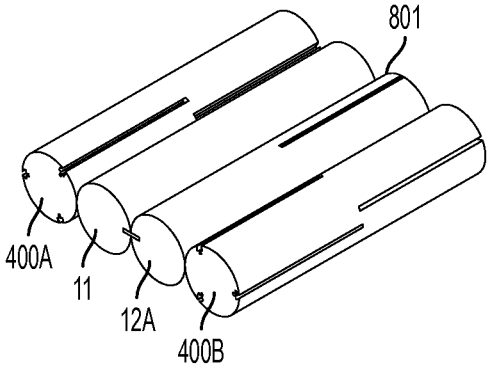
FIG. 9B shows a perspective view of the cylinders of FIG. 8A.
Figure 10:
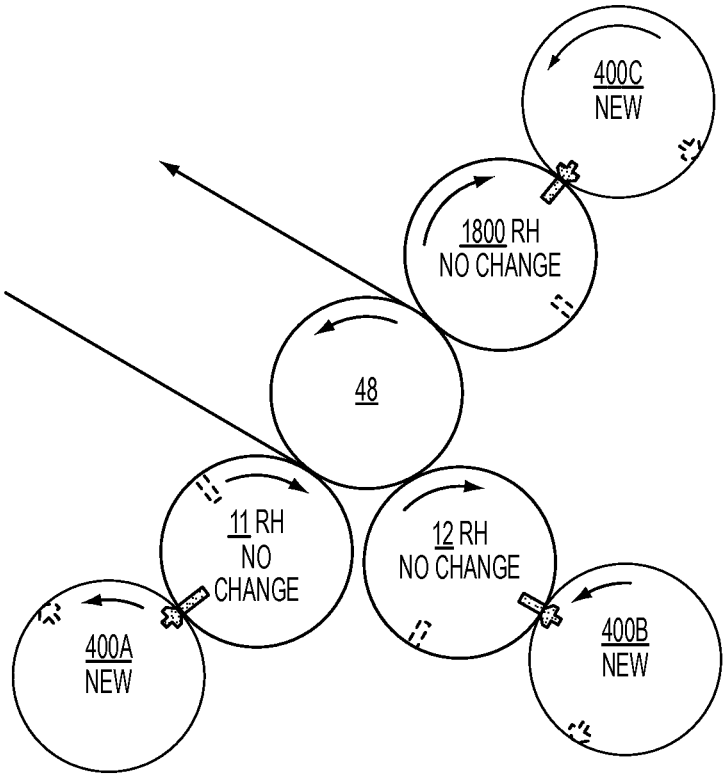
FIG. 10 shows an end view of the modification of a three color process unit to introduce handedness when utilizing three-around plate cylinders.

Further, in the embodiment of FIGS. 9A and 9B, the blanket cylinder (12A) generally requires modification as well to provide for the handedness by filling an existing slot (801) on one blanket cylinder (12A) and moving the slot 180 degrees to position (803) to avoid having a printing break in the middle of a page. This modification is not required without the three-around mode being used as there is no handedness present in the two-around mode. However, in the three-around mode, the modification is necessary to allow for correct alignment. FIG. 10 shows that while the handedness is necessary on a standard unit (103), it may not be a necessary change on a three color unit (105). Specifically, where a unit includes a half-deck (such as three color unit (105)) which are used in a dedicated non-reversing condition, the lower portion of the unit (103) may require handedness while the upper portion (half-deck (115)) generally does not. Should the half-deck (115), however, be desired to maintain its fully reversible nature, then the upper portion may also require replacement and modification of blanket cylinder (1800) to recognize handedness. FIG. 11 provides for a comparison of rotation showing how the handedness is required to provide for correct alignment of the plate (400A) and (400B) and blanket cylinders (12) and (12A).

Use of a three-around plate cylinder (400) may result in a fifty-percent increase in copy count per cylinder revolution. Thus, a three-around plate cylinder (400) increases the rate at which product is created, without increasing the speed of operation of the press (101). This permits fewer resources to be devoted to each final product, making the publication generally more profitable and more productive. This is accomplished without increasing wear and tear on the press unit (101), because it is run at the same speed.

In addition, the shorter paper may be more user-friendly and more desirable for some readers, including those who wish to read the paper in a confined space or simply not deal with larger pages. It also saves paper, which in turn reduces the manpower, capital, material costs, and support costs necessary to print a publication. In turn, this may increase the revenue potential and decrease the environmental impact of a publication.

While replacing a two-around plate cylinder (10) with a three-around plate cylinder (400) or one-around plate cylinder (600) so as to allow printing in three-around mode can result in paper savings, a smaller product, and higher productivity, folders (121) calibrated for a two-around plate cylinder (10) generally cannot function properly to cut and fold sheets generated from a three-around plate cylinder (400). The problem does not lie in the fact that sheets are produced at a greater rate of speed (as more sheets are produced per cylinder rotation); as folders (121) are structurally capable of operating at the faster rate required by such sheet generation. Rather, the problem lies in the necessary alterations to introduce the second fold at the proper place within the shorter sheets, and cut sheets at the shorter cut-off length generated by a three-around plate cylinder (400). Further, folders (121) have been designed to subdivide collection by dividing by 2. That is that either every cut is complete, or every other cut is complete. With papers coming in multiples of three, the first operation will still function (since every number is divisible by one) but the second will not.

This is best understood by looking at the folder of FIG. 3. A pin/collect cylinder (4) in a folder (121) which is calibrated for a two-around plate cylinder (10) may, as described above, be "three-around," or have a circumference that can bear three sheets generated by a two-around plate cylinder (10). Sheets generated by a three-around plate cylinder (400), with a shorter cut-off length, fit 4½ times around a pin/collect cylinder (4) of the same size and operating at the same speed as a three-around pin/collect cylinder (4) keyed to a two-around plate cylinder (10). Having 4½ sheets around a pin/collect cylinder (4) does not permit the cutting cylinder (3) to cut in the right places; that is, the blades (20) (21) will not interact with the paper (131) at appropriate breaks between sheets because the sheets are not moving past the cutting cylinder (3) at the appropriate rate due to the mismatch between the sheets and the pin/collect cylinder (4). Sheets that are cut incorrectly are then folded incorrectly, because the sheet being horizontally folded was not cut to properly align to an image, such that the second fold does not bisect the image as it generally should. Further, having an unequal number of sheets fit in each rotation means that the pin/collect cylinder (4) cannot engage the pages correctly as they are placed on in offset alignment.

These problems are particularly cogent because the number of sheets from a three-around plate cylinder (400) per pin/collect cylinder (4) is a noninteger; that is, there remains a half sheet that must be picked up by a subsequent rotation of the pin/collect cylinder (4), which means that on each rotation the placement of the breaks between the sheets moves relative to the interaction of the paper with the blades (20) (21). This generates inconsistent and inaccurate cutting of the paper (131) by the cutting cylinder (3).

One option to deal with this problem is to simply replace the existing folder with one having all three cylinders replaced with ones sized to the resultant three-around mode printed pages. While this can provide a solution, because such a folder (121) is designed to use multiples of two, it would generally be impossible to operate the folder (121) in a collect run with a three-around mode print. Further, the folder (121) would operate at a faster, and potentially undesirable, angular velocity.

It is, therefore, desirable that the relationship between a cutting cylinder and pin/collect cylinder of a folder be such that shorter sheets generated by a three-around printing mode are accurately and consistently cut and folded by the end folder (121). It is also desirable that a replacement end folder (500) have equivalent dynamics to the original end folder (121) relating to rate (in feet of paper per minute, or fpm) and angular velocity, or speed of rotation around the circumference of the pin/collect cylinder, even as the number of sheets per cylinder rotation (and therefore the ratio of sheets per foot of paper) increases at a 3:2 ratio due to the three-around plate cylinder (400) replacing the two-around plate cylinder (10).

Disclosed herein are replacement end folders (500) capable of cutting and folding sheets at a shorter cut-off length generated by a three-around plate cylinder (400) replacing a two-around plate cylinder (10) without having many of the problems created by simply resizing the cylinders of the folder. The first step in achieving this goal is to make the number of sheets per rotation of the pin/collect cylinder (14) an integer instead of the 4½ that exists in a current 2:3:3 cylinder. Rounding up to 5 is preferable to rounding down to 4, as a pin/collect cylinder (94) carrying five sheets per rotation will be larger than a cylinder carrying four sheets per rotation and so can rotate more slowly, having a lower angular velocity. Slower rotation and a lower angular velocity is generally preferable, as it may introduce less wear and tear on machinery and can improve the cleanliness of cuts. Maintaining or reducing the angular velocity of the folder (500) components, within the practical limits set by its size, also relates directly to maintaining or improving the quality of the final folded product. The lower the angular velocity, the less likely the product is to be damaged or folded inappropriately.

Figure 7:
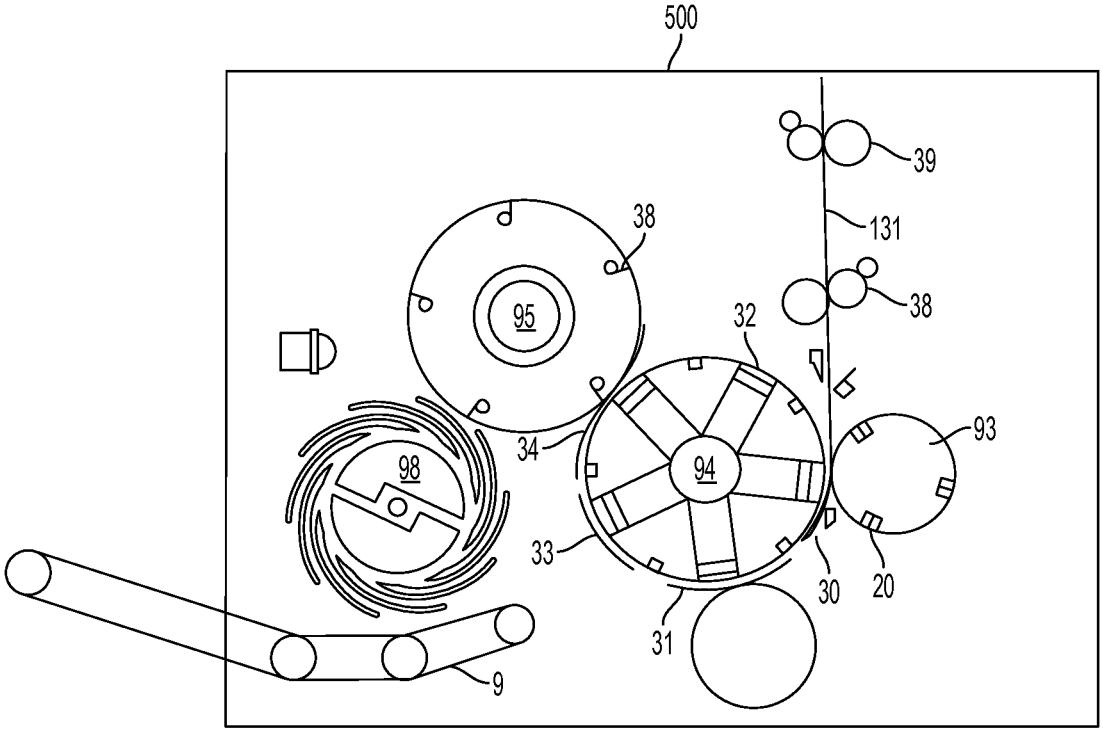
FIG. 7 provides an embodiment of a folder adjusted for a retrofitted press unit having a 3:5:5 ratio.

An altered folder (500) to accommodate three smaller pages being released at the same rate of two larger pages is also contemplated by this disclosure. An embodiment of a folder with such alterations is shown in FIG. 7. Where the folder (500) is a jaw-type folder, such alterations may comprise changing the ratio between the cutting cylinder (93) and the pin/collect cylinder (95) so that the cutting cylinder (93) is three-around and the pin/collect cylinder (95) is five-around. In turn, the jaw cylinder (95) would also be five-around, to continue functional interaction with a five-around pin/collect cylinder (94). This makes the folder (500) in FIG. 7 a 3:5:5 folder. Where the folder (500) is a rotary-type folder, such alterations may comprise changing the ratio between the cutting cylinder (93) and a folding cylinder (not shown) so that the cutting cylinder (93) is three-around and the folding cylinder is five-around.

In addition, because a folder (500) performing straight-run operation is more efficient than a folder (500) performing collect-run operation, it is also contemplated that the systems and methods disclosed herein may comprise changing the operation of the folder (500) from collect run to straight run in order to preserve the greater productivity introduced by replacing a two-around plate cylinder (10) with a three-around plate cylinder (400), or one-around plate cylinder (600), operating in three-around mode. Where a printing operation comprises multiple presses, existing press unit (101) components may be used to accomplish such a conversion from collect run to straight run. It is possible in straight run operation to use an existing 2:3:3 or similar ratio folder so long as the cut off length is selected to correspond to the page length produced in three-around mode.

An embodiment of a 3:5:5 replacement end folder (500) is shown in FIG. 7. As can be seen if FIG. 7, when operating in straight mode the circumference of the pin/collect cylinder (94) has four positions (30) (31) (33) (34) carrying sheets, with a position (32) which is currently empty. The cutting cylinder (93) becomes a three-around cylinder, but is sized so that the blades (20) (21) interact with the paper (131) at the breaks between the sheets. This 5:3 ratio between the pin/collect cylinder (94) and the cutting cylinder (93) means that each one-third reduction of the cutting cylinder (13) will bring a blade (20) (21) into contact with a break between sheets placed in positions (30) (31) (33) (34), and that each revolution of the pin/collect cylinder (14) carries an even integer number of sheets with a blank space to allow completion of the revolution.

Because the pin/collect cylinder (94) is adjusted to be five-around, the replacement folder (500) may also comprise a five-around jaw cylinder (95), as those cylinders are preferably in a 1:1 ratio for efficient operation. Thus, the replacement folder is in a 3:5:5 ratio between the cutting cylinder (93), pin/collect cylinder (94), and jaw cylinder (95).

The alterations to the end folder (500) and its ratios disclosed herein may yield a fifty percent productivity increase. For example, a folder capable of 60,000 impressions per hour (60 kiph) may, when replaced with a 3:5:5 folder, handle 90 kiph. In addition, a 3:5:5 folder (500) used with a three-around plate cylinder (400) has very similar dynamics to a 2:3:3 end folder (121) used with a two-around plate cylinder (10), in that the components have similar angular velocities and speeds of rotation since the page changes generally do not require significant resizing of the cylinders (13), (14) and (15)1. An additional advantage is that components for a 3:5:5 folder (500) are readily available, which minimizes the cost and logistics of adapting a folder to a replacement three-around plate cylinder (400).

In straight run operation (FIG. 3A), the replacement folder (500) would yield three products for every revolution of the three-around plate cylinder (400). In collect run operation (FIG. 3B), the replacement folder (500) would collect three printed sheets to produce one completed product. However, in practical operation, the 3:5:5 folder is generally unusable in collect run operation. This has to do with cutting of new sheets while interacting with collected sheets on the pin/collect cylinder (14). As can be seen from FIG. 7, the cutting cylinder (13) will interact with cutting surfaces on the pin/collect cylinder (14). As the pin/collect cylinder (14) also has sheets already collected thereon when in collect operation, there is a problem in that the cutting cylinder (13) will "trim"

already collected sheets. This produces a number of thin strips of paper which are either pressed into the pin/collect cylinder (14) or which become loose in the folder (121). This paper "spaghetti" can cause fouling and inaccurate cutting. For this reason, when operating in collect mode, a 3:5:5 folder (121) will generally require additional machinery such as a fan, blower, or vacuum to remove the paper spaghetti. While inclusion of such a device is contemplated in an alternate embodiment, use of such device is generally less preferred as it adds complexity and can reduce speed. Therefore, the 3:5:5 folder (121) will generally only be operated in a straight run.

Figure 8A:
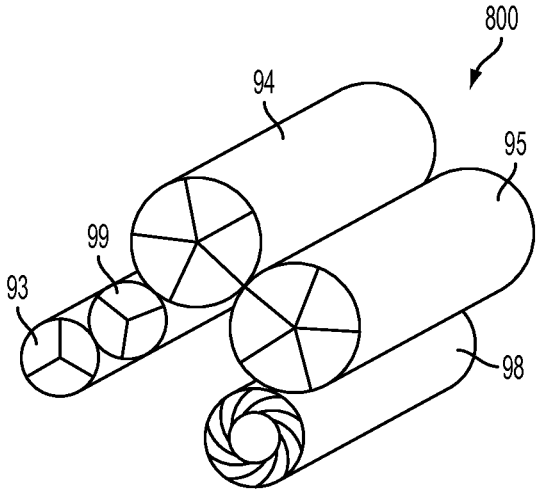
FIG. 8A shows a conceptual diagram illustrating the operation of a four cylinder folder in a 3:3:5:5 ratio.
Figure 8B:
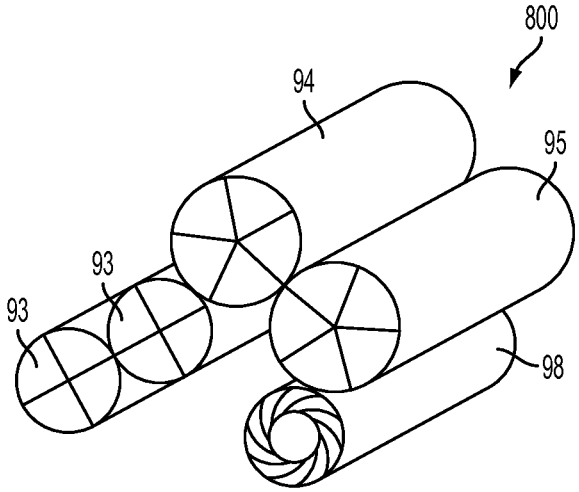
FIG. 8B shows a conceptual diagram illustrating the operation of a four cylinder folder in a 4:4:5:5 ratio.
Figure 8C:
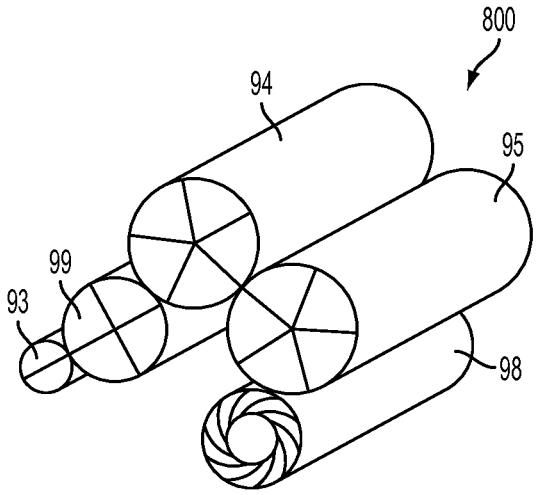
FIG. 8C shows a conceptual diagram illustrating the operation of a four cylinder folder in a 2:4:5:5 ratio.
Figure 8D:
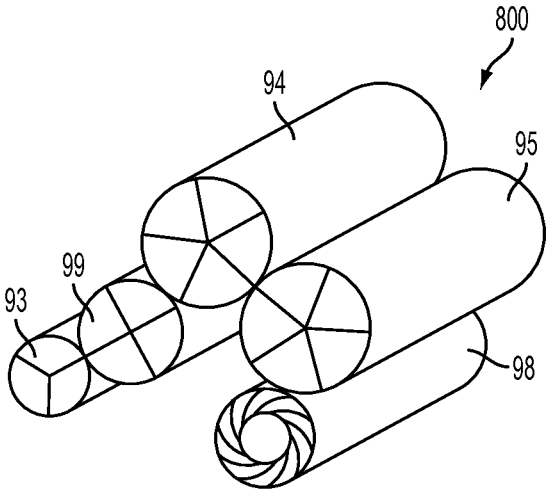
FIG. 8D shows a conceptual diagram illustrating the operation of a four cylinder folder in a 3:4:5:5 ratio.

In order to improve efficiency and eliminate the need for a blower in collect and operation, the folder (800) includes not only the traditional male cutting cylinder (93) but also include a female pin/cutting cylinder (99). This can provide for more efficient collect run on a three-around print when used with a five-around pin/collect cylinder (94) and a five-around jaw cylinder (95). Further, it can make it easier to place a folder designed to operate with a three-around mode printing, into the same footprint originally occupied by a 2:3:3 folder since angular positions between the cylinders can be altered. Four embodiments of folders (800) designed for this type of operation are shown in FIG. 8. These include a 3:3:5:5 folder (FIG. 8A), a 4:4:5:5 folder (FIG. 8B), a 2:4:5:5 folder (FIG. 8C), and a 3:4:5:5 folder (FIG. 8D). Generally, the 3:4:5:5 ratio is preferred as it takes less space and can occupy a similar, or the same, footprint to the original 2:3:3 folder while still operating in an efficient fashion. However, the 4:4:5:5 folder may be preferred where space is not an issue as it can provide for the best fold dynamics since it has the largest cylinders. Other ratios, while not depicted, may also be used. That includes, but is not limited to: a 2:4:4:4 folder.

The folder (800) types of FIG. 8A through 8D can operate in either straight and collect mode and therefore generally provide for more flexibility where such flexibility may be necessary or desired. This operation is generally similar to the operation of the 3:5:5 folder (500) of FIG. 7 but includes an additional female pin/cutting cylinder (99) so as to provide for a different placement and easier product transfer and operation. When a 3:4:5:5 folder (800) operates in straight mode the section leads of the paper will pass through the final set of nipping cylinders (38) and (39) and then engage the three-around female pin/cutting cylinder (99). As it continues to rotate, the knife of the three-around male cutting cylinder (93) engages the four-around cylinder (99) to cutoff a product. The cutoff product is retained via pins on the female pin/cutting cylinder (99) while it rotates to a timed relation with the five-around pin/collect cylinder (94). The pin/collect cylinder (94) then engages via pins the product and as it rotates slightly and the female pin/cutting cylinder (99) retracts pins thereby "handing off" the product to the five-around pin/collect cylinder (94). The pin/collect cylinder (94) then rotates to a timed relation with the five-around jaw cylinder (95). The pin/collect cylinder (94) tucking blade (37) extends thereby inserting the product into the jaws (38) of the five-around jaw cylinder (95) while simultaneously withdrawing pins. The jaws (38) complete closing on the product, thereby starting a folded product. The jaw cylinder (95) continues to rotate until the product is fully in folded form. The jaw cylinder (95) continues to rotate until a timed relation with the delivery fan cylinder (98). The folded product is released from the jaw cylinder (95) to the guides that direct the product to the delivery fan (98). The delivery fan (98) then rotates to a position where it then releases the product to the delivery conveyor (9).

This cycle is repeated for every successive product (that is, each paper) yielding a number of products equal to the ratio of each cylinder in equal proportion as the relative ratio of that cylinder. That is for a five-around cylinder—one complete rotation yields 5 products, for a three-around cylinder—one complete rotation yields 3 products, etc. Since the cylinders rotate at different angular speeds, the resultant numbers match up. Therefore, every cut of the male cutting cylinder (93) yields one complete product once it is transported through all successive cylinders.

While the above straight mode is still the preferred method of operation since it has increased speed, the 3:4:5:5 folder or any of the four cylinder folders (800) of FIGS. 8A through 8D may also operate in collect mode. In collect mode the section leads pass through the final set of nipping cylinders (38) and (39) and then engage the four-around female pin/cutting cylinder (99) as before. Similarly, as the four-around pin cylinder (99) continues to rotate, the knife of the three-around male cutting cylinder (93) engages to cutoff a first product. However, as the product is passed from the four-around female pin/cutting cylinder (99) prior to the collection of another page thereon (that occurs on the female cutting pin cylinder (94)), the cutting action between male cutting cylinder (93) and female pin cutting cylinder (99) only acts on a single page, eliminating the potential recutting of collected pages and creation of paper spaghetti.

In collect mode, the first product is one part of three parts required to be gathered (collected) to complete an entire product. This is different from a collection of a two-around mode where the product in collect mode had a multiple of two sheets in each collection. Thus, for this discussion, we will refer to parts 'A', 'B', 'C'. Part C, the first part, is retained via pins on the pin/female cutting cylinder (99) while it rotates to a timed relation with the five-around pin/collect cylinder (94). At this point the pin/collect cylinder (14) then engages via pins to part C and as it rotates slightly, the female pin/cutting cylinder (19) retracts pins thereby "handing off" part C to the pin/collect cylinder (14). While this occurs, the next position of the female pin/cutting cylinder) (19) engages, cuts and retains part B. The pin/collect cylinder (14) continues to rotate and retains (collects) part C and does not fold off to the jaw cylinder (15) while simultaneously taking successive "hand-offs" from the female pin cutting cylinder (19) of parts B then A. This action continues until parts C, B, and A are collected (retained) on the pin/collect cylinder (94). At this point, parts C, B, and A are just single parts retained on the pin/collect cylinder (94). None are gathered nor constitute a completed collect product.

The first part A is now tucked by the pin/collect cylinder (94) into the jaw cylinder (95) to finish transport out of the machine. In this case, the single part A is incomplete as a product and is scrap. However, as the appropriate parts continue to cycle, the parts continue to repeat in sequence CBA, CBA etc. successively. The interplay of the four-rotation (99) and five-rotation (94) cylinder will line the components up. Since the four-cylinder rotation of female pin/cutting cylinder (19) will introduce an additional space, effectively the five-around pin/collect cylinder (94) will have placed thereon C, B, A, space. The process will then repeat. As the other remaining position of the five-around pin/collect cylinder (94) is also an empty space, this is the position that the C from the female cutting cylinder (99) will be placed, then B will be placed on C, A on B and the position where A is on top is removed. Thus, you would have in organization once the process has started (and referring to the five-around positions of FIG. 7). C at position (34), CB at position (33) CBA at position (31), and position (30) and position (32) are empty. The combination CBA in position (31) would be pulled into the jaw folder (95) upon reaching it and in the next pass C would be placed at position (32), B would be placed at position (34) (on C) and A would be placed at position (33) (on CB). Position (31) and (30) would then be open (spaces) and the process would repeat.

Every time the product has had part A added on the pin/collect cylinder (94), it is folded off on jaw cylinder (95) and delivered complete or incomplete as A represents the top most part or last part to be gathered for a complete product. This is controlled by the timing of various cams. Meanwhile the various parts start to collect (stack) on their appropriate pin/collect cylinder (14) segment in the order CBA.

When the first complete product (CBA) is collected (stacked) on the pin/collect cylinder (94) and thence transported through the machine to the proper timed relation to the jaw cylinder (95), it is tucked by the pin/collect cylinder (94) into the jaw cylinder (95) and thence through the machine to deliver the first complete product to the delivery fan cylinder (98) and conveyor (9).

At this time the machine is fully charged with appropriate parts C, CB, CBA as appropriate and in such a relation as to deliver one complete product for every ⅗ rotation of the jaw (95) or pin/collect cylinder (94), or ¾rotation of the female pin/cutting cylinder (99), or one rotation of the male cutting cylinder (13) (equivalent of one rotation of the printing unit plate or blanket cylinder).

As opposed to the straight run, where every cut yielded a complete product, in this method of use, every 3 cuts of the cutting cylinder (93) (one complete rotation) yield one complete product (3 parts) once it is collected and transported through all successive cylinders (99), (94) and (95).

In an embodiment, alterations to the end folder (500) or (600) may be incorporated into a folder module which may replace the corresponding original end folder (121) components. The module may comprise any or all components of the new folder (500) or (600) which one of ordinary skill finds may be more easily replaced as a unit rather than altered individually. In an embodiment, where the end folder (121) is a jaw folder, the module may comprise the pin/collect cylinder (94), a jaw cylinder (95), and an additional cylinder such as a female cutting-pin cylinder (99) and any other desirable components, in addition to cutting cylinder (93) which may similarly operate as a drop-in module. In an embodiment where the folder is a rotary folder, the module may comprise a folding cylinder, and any other desirable components. It may additionally include a cutting cylinder and an additional female cutting cylinder. In a further embodiment, adapters may additionally or alternatively be used to mount or connect the module or its components to the existing press unit (101). The adapters may be of any structure that one of ordinary skill finds useful to functionally and securely connect the module or its components to the existing press unit (101).

As discussed, the alterations to the end folder (121) disclosed herein may be applied to any folder (500) type known or developed in the art, including rotary, jaw, and pinless designs and their functional equivalents. Any other necessary adjustments to the press unit (101) or the operation of those or other components, are also contemplated.

In a still further embodiment a folder module having two folding streams as input may be modified so that the folder (121) portion for one stream is designed to cut output from the press unit (101) in two-around mode and the other folder (800) portion is designed to cut output from the press units (101) in three-around mode. Specifically, most standard folders (121) have two folder modules. Thus, in an embodiment one half of the folder (121) may be replaced by a three-around module (e.g., a 3:4:5:5 folder) for three-around mode operation while the other is left a two-around (e.g., a 2:3:3 folder) for two-around mode operation. This can be useful in the retrofitting over time methodology for a pressline (100) discussed previously. In this way the folder can operate using its two-around mode set up while the pressline (100) is being upgraded, and immediately switch to three-around mode folding once the pressline (100) is completed. It should also be noted that if such a retrofit of one-around plate cylinders (600) and a partial folder refit having both two-around and three-around mode capability is completed, still further flexibility is provided to the pressline (100) as if this folder is left in this half-and-half configuration, the pressline (100) can operate in either two-around or three-around mode freely depending on the specific desire of the pressline (100) operator at the time.

In an alternative embodiment where collect run operation is maintained, it is contemplated that further alterations to the pressline (100) may be necessary to operate with a three-around plate cylinder (400). One such alteration may be to a skip slitter (not shown), which cuts every other sheet into the smaller tabloid format as opposed to the larger broadsheet format. Such cutting may serve to generate a tabloid-style insert or advertising section into an otherwise broadsheet publication. Because a skip slitter cuts every other sheet, it must be properly calibrated to the sheet's cut-off length. In addition, it must be calibrated to cut every ⅓ or ⅔ sheets generated by a three-around plate cylinder (400), rather than to cut every other sheet generated by a two-around plate cylinder (10). Replacing a two-around plate cylinder (10) with a three-around plate cylinder (400) may therefore comprise altering the knife, gearing, timing, or any other aspect of a skip slitter where collect run operation is maintained.

In preferred embodiments, the systems and methods disclosed herein for printing with a three-around plate cylinder (400), or a one-around plate cylinder (600), operating in three-around mode, comprise retrofitting an existing press unit (101) comprising two-around plate cylinders (10) (13), with three-around plate cylinders (400) or one-around plate cylinders (600) so it can operate in three-around mode. Such retrofitting permits lowering the cut-off length (thereby permitting greater productivity, creating a more user-friendly product, and saving paper) without investing in a new, extremely expensive press unit (101). Retrofitting can also permit continued use of an existing press unit (101) that is perfectly acceptable other than its inopportunely sized plate cylinders (10) (13) that require unduly large cut-off lengths. Retrofitting further can allow greater continuity of operation (and therefore greater continuity of revenue stream): simply exchanging a few components in an existing press unit (101) is a much less involved task than dismantling and removing an old press unit, and acquiring, installing, and optimizing a new press unit. It also means that employees do not need to learn the intricacies and eccentricities of a new press unit. Further, all press units (101) in the pressline may be modified along with the folder (121) being modified to provide a pressline having completely new page sizes, without any major component of the line being completely replaced.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A method of reducing the cut-off length of a newspaper, the method comprising:

providing a press unit having at least one existing plate cylinder, each of said existing plate cylinders having two existing plates attached thereto, each of said existing plates comprising generally half a circumference of the attached existing plate cylinder, said plate cylinders being thus configured to print two pages of a newspaper with each rotation; and replacing all said existing plate cylinders with new plate cylinders having generally the same length, diameter, and circumferences as the existing plate cylinders without modification to the frame of the press unit, said new plate cylinders having a single new plate attached thereto, each of said new plates comprising generally the entire circumference of the attached new plate cylinder configuring each of said new plate cylinders to print three pages of a newspaper, said three pages arranged about the circumference of said new plate cylinders such that each of said three pages comprises generally one-third of the circumference of said new plate cylinder.

2. The method of claim 1 wherein said replacing all said existing plate cylinders with new plate cylinders comprises:

removing said existing plate cylinders from said press unit; and replacing each of them with a new plate cylinder having said new plate attached thereto.

3. The method of claim 1 wherein said replacing all said existing plate cylinders with new plate cylinders comprises:

removing said existing plate cylinders from said press unit;

modifying each of said existing plate cylinders to have said single plate attached thereto; and placing said modified existing plate cylinders on said press unit as said new plate cylinders.

4. The method of claim 1 further comprising:

printing pages on said press unit, the printing comprising running the press unit at the same speed it had run prior to the replacing.

5. The method of claim 1 further comprising:

configuring each of said new plate cylinders such that said three pages arranged about said circumference of said new plate cylinders comprise a page arrangement and said page arrangement appears at least twice along said length of said new plate cylinders.

6. The method of claim 5 wherein said repeated page arrangements are aligned with each other about said circumference of said new plate cylinders.

7. The method of claim 1 wherein said repeated page arrangements are rotated relative to each other about said circumference of said new plate cylinders.

* * * * *